US007427422B2

(12) United States Patent
Wu et al.

(10) Patent No.: US 7,427,422 B2
(45) Date of Patent: Sep. 23, 2008

(54) METHOD OF FORMING A THICK FILM DIELECTRIC LAYER IN AN ELECTROLUMINESCENT LAMINATE

(75) Inventors: Xingwei Wu, Brampton (CA); George A. Kupsky, Sherwood Park (CA)

(73) Assignee: IFire Technology Corp., Fort Saskatchewan (CA)

( * ) Notice: Subject to any disclaimer, the term of this patent is extended or adjusted under 35 U.S.C. 154(b) by 0 days.

(21) Appl. No.: 11/122,301

(22) Filed: May 3, 2005

(65) Prior Publication Data

US 2005/0202157 A1 Sep. 15, 2005

Related U.S. Application Data

(60) Continuation of application No. 10/641,231, filed on Aug. 14, 2003, now abandoned, which is a division of application No. 09/540,288, filed on Mar. 31, 2000, now Pat. No. 6,771,019.

(60) Provisional application No. 60/134,299, filed on May 14, 1999.

(51) Int. Cl.
*B05D 5/06* (2006.01)

(52) U.S. Cl. ..... 427/66; 427/369; 427/372.2; 427/419.2; 427/541

(58) Field of Classification Search ..... 427/66, 427/541, 369, 372.2, 402
See application file for complete search history.

(56) References Cited

U.S. PATENT DOCUMENTS

| | | | |
|---|---|---|---|
| 2,990,602 A | 7/1961 | Brandmayr | |
| 3,435,104 A | 3/1969 | Brandmayr | |
| 3,456,048 A | 7/1969 | Brandmayr | |
| 3,806,759 A | 4/1974 | Kabaservice et al. | 313/506 |
| 3,862,046 A | 1/1975 | Walker et al. | |

(Continued)

FOREIGN PATENT DOCUMENTS

| | | |
|---|---|---|
| CA | 2012276 | 9/1995 |

(Continued)

OTHER PUBLICATIONS

Yamauchi, N., Kozawaguchi, H., Kogure, O. and B. Tsujiyama. 1987. "13.1: A Multicolor Thin-Film Electroluminescent Device with Patterned Phosphors." SID 87 Digest pp. 230-233.

(Continued)

*Primary Examiner*—Timothy Meeks
*Assistant Examiner*—Jimmy Lin
(74) *Attorney, Agent, or Firm*—Greenlee Winner and Sullivan PC

(57) ABSTRACT

The invention provides a method of forming a thick film dielectric layer in an EL laminate of the type including one or more phosphor layers sandwiched between a front and a rear electrode with the phosphor layer being separated from the rear electrode by a thick film dielectric layer. The method includes depositing a ceramic material in one or more layers by a thick film technique to form a dielectric layer having a thickness of 10 to 300 μm; pressing the dielectric layer to form a densified layer with reduced porosity and surface roughness; and sintering the dielectric layer to form a pressed, sintered dielectric layer which, in an EL laminate, has an improved uniform luminosity over an unpressed, sintered dielectric layer of the same composition.

38 Claims, 6 Drawing Sheets

U.S. PATENT DOCUMENTS 3,900,542 A 8/1975 Palmour et al.
4,041,140 A 8/1977 Nitta et al. ..... 423/561 R
4,075,449 A 2/1978 Yagi et al. ..... 200/315
4,188,565 A 2/1980 Mizukami et al. ..... 313/509
4,311,455 A 1/1982 Crownover
4,416,933 A 11/1983 Antson et al. ..... 428/216
4,418,118 A 11/1983 Lindors ..... 428/336
4,442,377 A 4/1984 Higton et al. ..... 313/503
4,462,817 A 7/1984 Wolfe et al. ..... 65/36
4,482,841 A 11/1984 Tiku et al. ..... 313/503
4,594,282 A 6/1986 Kawaguchi et al. ..... 428/216
4,613,793 A 9/1986 Panicker et al. ..... 315/169.3
4,615,933 A 10/1986 Traut ..... 428/252
4,622,186 A 11/1986 Mizutani ..... 254/62
4,643,858 A 2/1987 Mizutani ..... 254/62
4,654,099 A * 3/1987 Sandman ..... 156/220
4,670,355 A 6/1987 Matsudaira ..... 428/690
4,684,353 A 8/1987 DeSouza
4,686,110 A 8/1987 Endo et al. ..... 427/38
4,689,522 A 8/1987 Robertson ..... 313/506
4,692,288 A 9/1987 Rossmann et al. ..... 264/56
4,693,906 A * 9/1987 Lindmayer ..... 427/69
4,719,385 A 1/1988 Barrow et al. ..... 313/463
4,721,631 A 1/1988 Endo et al. ..... 427/66
4,725,344 A 2/1988 Yocom et al. ..... 204/192.15
4,727,003 A 2/1988 Ohseto et al. ..... 428/690
4,738,885 A 4/1988 Matsumoto ..... 425/64
4,741,876 A 5/1988 Rayburn ..... 254/346
4,749,421 A 6/1988 Matsui et al. ..... 156/89
4,751,427 A 6/1988 Barrow et al. ..... 313/503
4,757,235 A 7/1988 Nunomura et al. ..... 313/509
4,758,828 A 7/1988 Mitsumori ..... 340/703
4,792,500 A 12/1988 Kojima ..... 428/690
4,801,844 A 1/1989 Barrow et al. ..... 313/509
4,806,295 A 2/1989 Trickett et al. ..... 264/59
4,812,272 A 3/1989 Heinrich et al. ..... 264/65
4,833,000 A 5/1989 Trickett et al. ..... 428/137
4,857,802 A 8/1989 Fuyama et al. ..... 313/506
4,870,538 A 9/1989 Baldwin
4,877,994 A 10/1989 Fuyama et al. ..... 313/503
4,879,139 A 11/1989 Ootsuka et al. ..... 427/38
4,882,377 A * 11/1989 Sweet et al. ..... 524/267
4,894,116 A 1/1990 Barrow et al. ..... 156/643
4,897,319 A 1/1990 Sun ..... 428/690
4,916,496 A 4/1990 Tonomura et al. ..... 357/17
4,960,550 A 10/1990 Wright ..... 254/56
4,963,788 A 10/1990 King et al. ..... 313/503
4,977,350 A 12/1990 Tanaka et al. ..... 313/505
4,981,503 A 1/1991 Segawa et al. ..... 65/30.1
4,987,339 A 1/1991 Robertson ..... 313/502
5,032,374 A 7/1991 Pastor et al. ..... 423/561.1
5,047,686 A 9/1991 Robertson ..... 313/503
5,096,518 A 3/1992 Fujikawa et al. ..... 156/89
5,096,735 A 3/1992 Nakaya et al. ..... 427/38
5,104,683 A 4/1992 Robertson ..... 427/38
5,107,174 A 4/1992 Galluzzi et al. ..... 313/503
5,164,799 A 11/1992 Uno ..... 313/509
5,178,571 A 1/1993 Mase ..... 445/24
5,182,491 A 1/1993 Taguchi et al. ..... 313/503
5,194,290 A 3/1993 Robertson ..... 427/526
5,234,556 A 8/1993 Oishi et al.
5,235,246 A 8/1993 Konishi ..... 313/509
5,309,070 A 5/1994 Sun et al. ..... 313/503
5,314,759 A 5/1994 Harkonen et al. ..... 428/690
5,348,760 A 9/1994 Parker et al. ..... 427/9
5,352,395 A 10/1994 Kallenbach et al. ..... 264/62
5,368,667 A 11/1994 Minh et al. ..... 156/89
5,369,333 A 11/1994 Inoguchi et al. ..... 313/509
5,370,760 A 12/1994 Mori et al. ..... 156/89
5,372,839 A 12/1994 Mikami et al. ..... 427/66
5,432,015 A 7/1995 Wu et al.
5,445,898 A 8/1995 Budzilek et al. ..... 428/690
5,482,603 A 1/1996 Kawashima et al. ... 204/192.26
5,484,750 A 1/1996 Greskovich et al. ..... 501/86
5,554,449 A 9/1996 Tonomura et al. ..... 428/690
5,581,150 A 12/1996 Rack et al. ..... 313/509
5,598,059 A 1/1997 Sun et al. ..... 313/509
5,602,445 A 2/1997 Solanki et al.
5,634,835 A 6/1997 Wu et al.
5,641,582 A 6/1997 Nire et al. ..... 428/690
5,646,480 A 7/1997 Carroll et al. ..... 313/503
5,667,607 A 9/1997 Sugiura et al. ..... 156/67
5,667,655 A 9/1997 Libman et al. ..... 204/485
5,670,207 A 9/1997 Nire et al. ..... 427/126.2
5,675,217 A 10/1997 Kang ..... 313/509
5,677,594 A 10/1997 Sun et al. ..... 313/503
5,700,591 A 12/1997 Okajima et al. ..... 428/690
5,716,501 A 2/1998 Kawashima et al. ... 204/192.26
5,729,269 A 3/1998 Ohnishi et al. ..... 313/500
5,742,322 A 4/1998 Cranton et al. ..... 347/238
5,756,147 A 5/1998 Wu et al.
5,789,860 A 8/1998 Inoguchi et al. ..... 313/506
5,796,120 A 8/1998 Summers et al. ..... 257/30
5,888,410 A 3/1999 Ishihara et al. ..... 216/5
5,912,532 A 6/1999 Oh et al. ..... 313/503
5,932,327 A 8/1999 Inoguchi et al. ..... 428/212
5,939,825 A 8/1999 Sun et al. ..... 313/503
5,955,835 A 9/1999 Oh et al. ..... 313/503
6,023,073 A 2/2000 Strite
6,099,979 A 8/2000 Inoguchi et al. ..... 428/690
6,278,658 B1 8/2001 Skinner et al.
6,316,100 B1 11/2001 Kodas et al.

FOREIGN PATENT DOCUMENTS

EP 111568 6/1984
EP 145470 6/1985
GB 818069 8/1959
GB 1449602 9/1976
JP 50-78582 6/1975
JP 50-102283 8/1975
JP 51-1085 1/1976
JP 51-60488 5/1976
JP 51-64887 6/1976
JP 52-9366 1/1977
JP 55-90466 7/1980
JP 55-167131 12/1980
JP 56-93289 7/1981
JP 58-29880 8/1981
JP 57-202687 12/1982
JP 58-204824 11/1983
JP 58-208135 12/1983
JP 59-5268 1/1984
JP 61-230296 4/1985
JP 61-47097 3/1986
JP 63-44685 8/1986
JP 61-230294 10/1986
JP 61-231584 10/1986
JP 63-174297 1/1987
JP 63-200543 2/1987
JP 63-141986 3/1987
JP 64-63297 9/1987
JP 1-71899 11/1987
JP 1-130494 11/1987
JP 62-268092 11/1987
JP 62-278791 12/1987
JP 63-995 12/1987
JP 1-286290 5/1988
JP 63-164196 7/1988
JP 2-132791 11/1988
JP 1-272095 10/1989
JP 1-311188 12/1989
JP 2-44691 2/1990
JP 4-75295 7/1990

| | | |
|---|---|---|
| JP | 02-199793 | 8/1990 |
| JP | 3-24756 | 4/1991 |
| JP | 3-105894 | 5/1991 |
| JP | 3-207785 | 9/1991 |
| JP | 4-6275 | 2/1992 |
| JP | 4-94094 | 3/1992 |
| JP | 5-290971 | 4/1992 |
| JP | 6-13180 | 8/1992 |
| JP | 5-72078 | 10/1993 |
| JP | 7-90262 | 4/1995 |
| JP | 7-44072 | 5/1995 |
| JP | 7-258630 | 10/1995 |
| JP | 7-335382 | 12/1995 |
| JP | 8-31571 | 2/1996 |
| JP | 8-96958 | 4/1996 |
| JP | 9-134783 | 5/1997 |
| JP | 10-8044 | 1/1998 |
| JP | 10-223370 | 8/1998 |
| JP | 11-87058 | 3/1999 |
| WO | WO88/09268 | 12/1988 |

OTHER PUBLICATIONS

Konishi, T., Fujita, Y., Minamoto, M., Yamamoto, S., and Y. Tanaka. 1991. "14.1: A 9.3-in.-Diagonal Multi-Color TFEL Display Pane with Patterned Phosphor Structure." SID 91 Digest pp. 271-274.

Nire, T., Matsumo, A., Wada, F., Fuchiwaki, K. and A. Miyakoshi. 1992. "19.4: Multicolor TFEL Display Panel with a Double-Heterointerface-Structured Active Layer." SID 92 Digest pp. 352-355.

Parodos, T., Maruska, H.P., Halverson, W., Budzilek, R.A., Monarchie, D. and E. Schlam. 1993. "32.5: Late-News Paper: Ion Implantation for Full-Color Electroluminescent Displays." SID 93 Digest pp. 777-779.

Haaranen, J., Harju, T., Heikkinen, P., Harkonen, G., Leppanen, M., Lindholm, T., Maula, J., Maaltanen, J., Pakkala, A., Soininen, E Soinninen, M., Tornqvist, R. and J. Vijanen. 1995. "42.1: 512(x3)×256 RGB Multicolor TFEL Display Based on "Color by White."" SID 95 Digest pp. 883-886.

Thomas, C.B., Stevens, R., Cranton, W.M., McClean, I.P., Craven, M.R., and A.H. Abdullah. 1995. "42.2: Laterally Emitting TFEL Display Devices." SID 95 Digest pp. 887-890.

Miyata, T., Minami, T., Honda, Y. and S. Takata. 1991. "6.3: A High-Level Light- and Sound-Emitting EL Display Fabricated Using a Postannealed ZnS:Mn Thin Film Deposited on a Piezoelectric Ceramic Sheet." SID 91 Digest pp. 70-73.

Soininen, E., Leppanen, M. and A. Pakkala. 1993. "EL-4: Bright and Stable Blue Electroluminescent Device Based on SrS:Ce." Eurodisplay 93 Digest. pp. 233-236.

Leppanen, M., Harkonen,G., Pakkala, A., Soininen, E. and R. Tornqvist. 1993. "EL-3: Broadband Double Layer Phosphor for an Inverted Filtered RGB Electroluminescent Display." Conference document "EL-3," 13th International Display Research Conference Aug. 31-Sep. 3, Strasbourg, France, pp. 229-232.

Wu, X.W., Dalacu, N., and A.H. Kitai. 1990. "Contrast Enhancement for Ceramic Insulator Electroluminescent Devices." J. Electrochem. Soc. 137 (9): 2987-89.

Takahashi, K. Shibuya, K. and A. Kondo. 1992. "Degradation Induced by the $Sr^{2-}$ Vacancies in SrS:Ce Electroluminescent Devices." J. Crystal Growth 117:979-82.

King, C.N. 1990, "Device Structure and Processing of Color EL Displays." Acta Polytechnica Scandinavica (5th Intl. Conference on Electroluminescence), pp. 59-67.

Onisawa, K., Abe, Y., Nakayama, T. and M. Hanazono. 1991. "Effects of Substrate Temperature during Phosphor Layer Deposition on Luminance of SrS:Ce Blue-Green-Emitting Thin-Film Electroluminescent Devices." Jpn. J. Appl. Physics 30(2):314-19.

Fukao, R., Fujikawa, H. and Y. Hamakawa. 1989. "Improvement of Luminous Efficiency in ZnS:Tb, F Thin-Film Electroluminescent Devices Using Ferroelectric $PbTiO_3$ and Silicon Nitride as Carrier Accelerating Buffer Layers." Jpn. J. Appl. Physics 28(12):2446-49.

Mikami, A., Yashima, I. and F. Kajikawa. 1996. "New Developments in ZnS Type EL Displays." In "Inorganic and Organic Electroluminescence" eds. R.H. Mauch and H.E. Gumlich. Berlin: Wissenschaft und Technik Verlag. pp. 369-374.

Davidson, M.R., Waldrip, K.E., Lewis, J., Moorehead, D., Lambers, E., Sun, S.-S. and P.H. Holloway. 1998. "Sputter Deposition of $Mg_xZn_{1-x}S$:Mn for EL Phosphors." In "Extended Abstracts of the Fourth Intl. Conf. on the Sci. and Tech. of Display Phosphors. 9th Intl. Workshop on Inorganic and Organic Electroluminescence." Sep. 14-17. Bend, Oregon, pp. 235-237.

Tornqvist, R. 1992. "Multicolour Thin Film Electroluminescent Displays." Proc. 6th Workshop on Electroluminescence, El Paso 1992. pp. 329-336.

Miyata, T., Minami, T., Takata, S. and I. Fukada. 1991. "14.5: New High-Luminance Multicolor TFEL Devices Using an Oxide Phosphor Emitting Layer." SID 91 Digest pp. 286-289.

Tsurumaki, N., Watanabe, T. and T. Nire. 1990. "P 07: Multi Color TFEL Display Panel with a Broad Band Phosphor and Color Filters." Conference document "P07," 10th International Display Research Conference, Sep. 25-27, 1990, Amsterdam, The Netherlands, pp. 212-215.

Rack, P.D., Holloway, P.H., Pham, L. Wager, J., Sun, S.-S., Dickey, E. and C.N. King. 1995. "P-27: Brighter Blue $Ca_xSr_{1-x}Ga_2S_3$:Ce EL Devices with an Electron Injection Layer." SID 95 Digest, pp. 480-483.

Bailey, P., Carkner, D. and X. Wu 1995. "P-28: A Thick/Thin Film ac Hybrid EL Display for Use in Monochrome and Full-Color Applications." SID 95 Digest pp. 484-487.

Wu, X., Bailey, P., Foo, K. and J.A.R. Stiles. 1994. "P-34: Electroluminescent Display with a Thick-Film Dielectric Layer." SID 94 Digest pp. 558-561.

Liu, G., Lobban, K. and P. Bailey. 1998. "P-50: Investigation of Rare-Earth-Doped Thiogallates as Potential Phosphors for TDEL Displays." SID 98 Digest pp. 648-651.

Nunomura, K., Y. Sano, Y. and K. Utsumi. 1987. "TFEL Character Module Using a Multilayer Ceramic Substrate." Proc. SID 28(4): 351-55.

Carkner, D. 1997. "Thick Dielectrics Give EL a New Spin." SID pp. 10-13.

Ohmi, K., Tanaka, S., Yamano, Y., Fujimoto, K., Kobayashi, H., Mauch, R.H., Velthaus, K.O. and H.W. Schock. 1992. "S19-4: White Light Emitting Electroluminescent Devices with $(SrS:Ce/ZnS:Mn)_n$ Multilayered Thin Films." Technical Digest of the Japan Displays 1992.

Okamoto, F. and K. Kato. 1983. "Preparation and Cathodoluminescence of CaS:Ce and $Ca_{1-x}Sr_xS$:ce Phosphors." J. Electrochem. Soc. pp. 432-436.

Mach, R. and Muellar, G.O. (1991) "Physics and technology of thin film electroluminescent displays"; *Semicond. Sci. technol.* 6:305-323.

Brown and Fischer, (Apr. 1961) "Properties of Hot-Pressed Barium Titanate," USASRDL TEchnical Report 2196.

* cited by examiner

METHOD OF FORMING A THICK FILM DIELECTRIC LAYER IN AN ELECTROLUMINESCENT LAMINATE

CROSS-REFERENCE TO RELATED APPLICATIONS

This application is a continuation of U.S. application Ser. No. 10/641,231, now abandoned, filed Aug. 14, 2003, which is a divisional of U.S application Ser. No. 09/540,288, filed Mar. 31, 2000, now U.S. Pat. No. 6,771,019 issued on Aug. 3, 2004, which, in turn, claims priority to U.S. provisional application No. 60/134,229, filed May 14, 1999, all of which are incorporated by reference in their entirety.

FIELD OF THE INVENTION

This invention relates to AC electroluminescent (EL) devices fabricated using thin Film and/or thick film technologies. The invention also relates to full colour EL devices.

BACKGROUND OF THE INVENTION

U.S. Pat. No. 5,432,015, issued Jul. 11, 1995, to Wu et al., and U.S. Pat. No. 5,756,147, issued May 26, 1998, to Wu et al. disclose an electroluminescent laminate structure which combines a thick film dielectric layer with thin film layers, and a rear to front method of forming same on a rigid, rear substrate. Solid state displays (SSD) using this hybrid thick film/thin film technology have been demonstrated to have good performance and brightness (luminosity) in monochrome (ZnS:Mn phosphor) and full colour n(ZnS:Mn/SrS:Ce bilayer phosphor) applications (Bailey et al., SID 95 Digest, 1995), however, improvements are still needed.

The potential for EL as a competitive alternative for fabricating flat panel displays has been hindered by the inability to generate bright, stable full colour. This has resulted in EL only penetrating markets for niche applications, in which the inherent benefits of the technology, such as ruggedness, wide viewing angle, temperature insensitivity, and fast time response, are needed.

Two basic alternatives have been used to produce full colour EL devices. One approach is to use patterned phosphors, that is alternating red, green and blue (RGB) phosphor elements in a layer (see for example U.S. Pat. No. 4,977,350, issued Dec. 11, 1990, to Tanaka et al.). This approach has the disadvantage of requiring the three phosphors to be patterned into red, green and blue sub-pixels that make up each pixel, phosphors to be patterned into red, green and blue sub-pixels that make up each pixel, in separate steps. Furthermore, the three colours cannot all be produced brightly enough by currently available EL phosphors to gain the brightness advantage desired. A second approach is to use a colour by white technique, first described by Tanaka et al., (SID 88 Digest, p 293, 1988, see also, U.S. Pat. No. 4,727,003, issued Feb. 23, 1988 to Ohseto et al.). In the colour by white method, the phosphor layer comprises layers of phosphors, typically ZnS:Mn and SrS:Ce, which when superimposed produce white light. Red, green and blue sub-pixels are then obtained by placing a patterned filter in front of the white light. The white phosphor emits light at wavelengths over the entire visible portion of the electromagnetic spectrum, and the filters transmit a narrowed range of wavelengths corresponding to the colours for each sub-pixel. This approach has the disadvantage of relatively poor energy efficiency, in high measure because a high fraction of the light is absorbed in the filters and the overall energy efficiency of the display is correspondingly reduced.

Another requirement for full colour displays is gray scale capability, that is the ability to generate a number of defined and consistent luminosities (light emission intensities) for each sub-pixel. Typically, 256 gray scale luminosities span a range from zero to full luminosity controlled by predetermined input electrical signals for each sub-pixel. This number of gray levels provides a total of about 16 million individual colours.

Electroluminescent displays have pixels and sub-pixels that are defined by intersecting sets of conductor stripes at right angles to one another on opposite sides of a phosphor layer. These sets of stripes are respectively referred to as "rows" and "columns". The sub-pixels are independently illuminated using an addressing scheme called passive matrix addressing. This entails sequentially addressing the rows by applying a short flat-topped electrical pulse with a peak voltage called the threshold voltage sequentially on each of the rows such that the duration of the pulse is less than the time allocated for addressing each row. Electrical pulses, each with a defined and independent peak voltage, termed the "modulation voltage", are simultaneously applied to each of the columns intersecting the addressed row. This provides independently controllable voltages across the sub-pixels making up the pixels along that row, in accordance with the instantaneous luminosity required for each sub-pixel to achieve the desired pixel colours. While each row is being addressed, the remaining rows are disconnected, or are connected to a voltage level near zero. Independent operation of all sub-pixels on the display requires that sub-pixels not on the addressed row do not illuminate. The electro-optical characteristics of the sub-pixels on an electroluminescent display facilitate meeting this requirement, by virtue of the fact that no luminosity is generated if the voltage across the sub-pixels is below the threshold voltage.

The time required to address all the rows in a display is called a frame, and for video images, the frame repetition rate must be at least about 50 Hz in order to avoid image flicker. At the same time there is a maximum frame repetition rate, typically about 200 Hz, that is achievable due to a limitation on the voltage rise time associated with the electrical characteristics of the display and its associated electronics. In principle, a measure of gray scale can be achieved by controlling the average pixel luminosity by modulating the average frame rate. This requires omitting a fraction of the electrical pulses over a suitably short period of time. In practice, however, due to the limited range of frame rates, only a few levels of gray scale can be realized this way. Another option, called dithering, is to extinguish one or more pixels in the immediate vicinity of a pixel where reduced luminosity is required, thereby spatially modulating luminosity. This technique, however, causes a loss of display resolution and image quality.

The preferred method of gray scale control is to control the instantaneous sub-pixel luminosity, which must be done by modulating the electrical pulse peak voltage, pulse duration or pulse shape. At the same time, to minimize power consumption in electroluminescent displays addressed using passive matrix addressing, it is desirable to have the row voltage as close as possible to the threshold voltage above which luminosity is generated. This requires the threshold voltage for all sub-pixels to be equal.

Filters used to tailor the spectral emission characteristics of sub-pixels typically do not have ideal characteristics. They do not have perfect transmission in the desired wavelength ranges to achieve the desired red, green and blue colours, and they have some optical transparency in the wavelength ranges where they should be opaque. These deviations from ideal behavior impose design limitations on the overall pixel design. For example, the polymer based blue filters commonly used for electroluminescent and other types of flat panel displays have some transmission also in the red portion of the spectrum. The need to suppress red contamination of the blue pixel requires that thicker polymer films be used, which reduces the transparency in the desired blue wavelength range. They also have some transparency in the green wavelength range introducing a similar requirement for thicker polymers that are less transparent to blue light. To meet the requirements for full colour displays, the ratios of luminosity for red:green:blue sub-pixels should be 3:6:1, to give a white colour for that pixel. The CIE colour coordinates for red sub-pixels should be in the range $0.60<x<0.65$ and $0.34<y<0.36$. The CIE colour coordinates for green sub-pixels should be in the range $0.35<x<0.38$ and $0.55<y<0.62$. For blue sub-pixels the CIE colour coordinates should be in the range $0.13<x<0.15$ and $0.14<y<0.18$. The combined (white) luminosity for a pixel comprising red, green and blue sub-pixels should be at least about 70 candelas per square meter ($cd/m^2$) and the CIE colour coordinates for full white should be in the range $0.35<x<0.40$ and $0.35<y<0.40$. Higher luminosity is desirable for some applications.

Phosphors useful in electroluminescent displays are well known, and consist of a host material and an activator or dopant. The host material is usually a compound of a Group II element of the periodic table, with a Group VI element, or is a thiogallate compound. Examples of typical phosphors include zinc sulfide or strontium sulfide, with a dopant or activator which functions as the luminescent center when an electric field is applied across the phosphor. Typical activators with phosphors based on zinc sulfide include manganese (Mn) for an amber emission, terbium (Tb) for a green emission and samarium (Sm) for a red emission. A typical activator with phosphors based on strontium sulfide is Ce for a blue-green emission. It is conventional to refer to phosphors as, for example, SrS:Ce to designate a phosphor based on SrS doped with Ce, and ZnS:Mn to designate a phosphor based on ZnS doped with Mn, and this convention is used herein. It is also conventional, when using the formula for the phosphor, for example as in ZnS, to mean phosphors which are formed predominantly from a stoichiometric zinc sulfide. Other elements might be included in the host material for the phosphor, however it is typically still referred to as a phosphor based on the predominant component of the host material. Thus for instance when referring to a phosphor based on zinc sulfide, or a zinc sulfide phosphor, the terminology includes both pure zinc sulfide as a host material and, for example, the phosphor $Zn_{1-x}Mg_xS$:Mn (designating a phosphor based on zinc sulfide but also including magnesium sulfide in the zinc sulfide host material, doped with Mn), although it is also understood that ZnS and $Zn_{1-x}Mg_xS$ are different host materials. This phosphor terminology is used herein and the patent claims.

SUMMARY OF THE INVENTION

The present invention provides improvements in a thick film dielectric layer for use in a hybrid thick film/thin film electroluminescent device. The thick film dielectric layer of this invention is formed by thick film techniques from a dielectric material having a high dielectric constant, generally greater than about 500. The improvements are realized by compressing, for example by isostatic pressing, the thick film dielectric layer prior to sintering, to significantly reduce the porosity and the thickness of the layer, and to significantly increase the dielectric strength of the layer. The result is an unexpected improvement in the dielectric properties of the dielectric layer, significant reductions in the thickness, porosity, void space and interconnectedness of the void space of the layer, and an improvement in the surface smoothness of the layer, leading to more uniform luminance and reduced dielectric breakdown in electroluminescent displays formed therefrom.

Electroluminescent laminates made with the thick film dielectric as set forth in U.S. Pat. No. 5,432,015, generally show uniform luminosity as viewed by the naked eye, but when viewed under a ×100 microscope show a mottled appearance with some areas brightly illuminated and other areas dimly illuminated or not illuminated at all. When the driving voltage is near the threshold voltage this mottled appearance is most pronounced. The effect is diminished as the voltage is increased above this value and all regions become illuminated. The effect of this behavior is that the onset of luminosity occurs gradually as the voltage is raised above the nominal threshold value and the rate of increase in the average luminosity with increasing voltage is relatively low. The scale of the observed variability of the luminosity is of the order of 10 μm. In contrast, electroluminescent laminates made with a thick film dielectric layer which has been isostatically pressed prior to sintering, in accordance with this invention, do not show this mottled characteristic of the luminosity near the threshold voltage and increases nearly linearly up to about 50 volts above the threshold voltage, so that the average luminosity at a fixed voltage above the threshold voltage is about 50% higher than for an otherwise identical electroluminescent laminate. "Uniform luminosity", as used herein, means the luminosity resolved to a scale of about 10 μm appears uniform.

Broadly stated, in one aspect of the invention there is provided a method of forming a thick film dielectric layer in an EL laminate of the type including one or more phosphor layers sandwiched between a front and a rear electrode, the phosphor layer being separated from the rear electrode by the thick film dielectric layer, comprising:

depositing a ceramic material in one or more layers on a rigid substrate providing the rear electrode, by a thick film technique, to form a dielectric layer having a thickness of 10 to 300 μm;

pressing the dielectric layer to form a densified layer with reduced porosity and surface roughness; and sintering the dielectric layer to form a pressed, sintered dielectric layer which, in an EL laminate, has an improved uniform luminosity over an unpressed, sintered dielectric layer or the same composition.

In another broad aspect, the invention provides an improved combined substrate and dielectric layer component for use in an EL laminate, comprising:

a rigid substrate providing a rear electrode;

a thick film dielectric layer on the substrate providing the rear electrode, the thick film dielectric layer being formed from a pressed, sintered ceramic material having, compared to an unpressed, sintered dielectric layer of the same composition, improved dielectric strength, reduced porosity and uniform luminosity in an EL laminate.

In still a further broad aspect, the invention provides an EL laminate, comprising:

a planar phosphor layer;

a front and rear planar electrode on either side of the phosphor layer;

a rear substrate providing the rear electrode, the rear substrate having sufficient mechanical strength and rigidity to support the laminate; and a thick film dielectric layer on the substrate providing the rear electrode, the thick film dielectric layer being formed from a pressed, sintered ceramic material having, compared to an unpressed, sintered dielectric layer of the same composition, improved dielectric strength, reduced porosity and uniform luminosity in an EL laminate.

The present invention further provides a patterned phosphor structure particularly useful in AC thin film/thick film electroluminescent devices, and also useful in AC thin film electroluminescent devices if the thickness of the phosphor over the sub-pixels is not too great. In the phosphor structure of the invention, the emitted light from the phosphor underlying the red, green and blue sub-pixels falls within a narrowed wavelength range of the visible electromagnetic spectrum that more closely matches the range transmitted by the respective filters. In this manner, both the luminosity and the energy efficiency of the display can be substantially increased over the values achievable with a conventional colour by white phosphor design. Another feature of the patterned phosphor structure of the present invention is that the sub-pixel threshold voltages can be made equal and, the relative luminosities of the sub-pixels can be set so that they bear set ratios to one another at each operating modulation voltage used to generate the desired luminosities for red, green and blue. Preferably, the set ratios remain substantially constant over the full range of the modulation voltage, for proper colour balance. Most preferably, for a full colour display, the set luminosity ratios for the red, green and blue sub-pixels are in the ratio of about 3:6:1, or sufficiently close to this ratio so as to enable adequate colour fidelity (gray scale).

To reduce the negative impact of the limitations inherent in filter characteristics, it is desirable to use a phosphor for the blue sub-pixels that does not emit significant intensities of green or red light. Cerium doped strontium sulfide (SrS:Ce), optionally codoped with phosphorus, preferably prepared as set out herein, provides desirable CIE colour coordinates and luminosity for the blue, and optionally for the green sub-pixels. For green sub-pixels, manganese doped zinc sulfide (ZnS:Mn) does not generally provide an adequate luminosity when filtered to provide acceptable colour coordinates, but in accordance with this invention, it can be combined with cerium doped strontium sulfide to give higher luminosity with good colour coordinates. Alternatively, $Zn_{1-x}Mg_xS$:Mn, which, with an appropriate ratio of Zn to Mg, has a higher luminosity in the green region of the spectrum than does ZnS:Mn, can be used for the green sub-pixels, optionally with ZnS:Mn. Either or both of the $Zn_{1-x}Mg_xS$:Mn or the ZnS:Mn phosphors can be used for the red sub-pixels, x being between 0.1 and 0.3. In accordance with this invention, one or more means are included with the one or more of the phosphor deposits for setting and equalizing the threshold voltages of the sub-pixels, and for setting the relative luminosities of the sub-pixels so that they bear set ratios to one another at each operating modulation voltage used to generate the desired luminosities for red, green and blue. Threshold voltage means the highest amplitude of a voltage pulse that, when applied to a sub-pixel at the desired repetition rate, generates a measurable filtered luminosity less than the lowest specified gray scale luminosity for that sub-pixel. Thus, the means for setting and equalizing the threshold voltages also functions to set the relative sub-pixel luminosities so that they bear set ratios to one another over the full range of the modulation voltage used. Generally, the means is one or more of (a) a threshold voltage adjustment layer formed from a dielectric or semiconductor material which is located in one or more of the positions of over, under and embedded within one or more of the phosphor deposits, and/or (b) one or more of the phosphor deposits being formed with different thicknesses.

It should be noted that the terms "sub-pixel" and "sub-pixel phosphor elements" are used interchangeably herein to refer to the phosphor deposits for a particular red, green or blue sub-pixel element, along with any threshold voltage adjustment deposit associated with that sub-pixel element.

Appropriate colour filters can be chosen for the three sub-pixels to achieve self-consistent optimization of luminosity and colour coordinates for each, and overall pixel energy efficiency. The present invention has application to other colour phosphors, the strontium sulfide and zinc sulfide phosphors being representative only. Usually, at least two different phosphors are used, each being formed from different host materials. It is also possible to extend the present invention to three or more different phosphor layers for further optimization.

Broadly stated, the invention provides a patterned phosphor structure having red, green and blue sub-pixel phosphor elements for an AC electroluminescent display, comprising:

at least a first and a second phosphor, each emitting light in different ranges of the visible spectrum, but whose combined emission spectra contains red, green and blue light;

said at least first and second phosphors being in a layer, arranged in adjacent, repeating relationship to each other to provide a plurality of repeating at least first and second phosphor deposits; and one or more means associated with one or more of the at least first and second phosphor deposits, and which together with the at least first and second phosphor deposits, form the red, green and blue sub-pixel phosphor elements, for setting and equalizing the threshold voltages of the red, green and blue sub-pixel phosphor elements, and for setting the relative luminosities of the red, green and blue sub-pixel phosphor elements so that they bear set ratios to one another at each operating modulation voltage used to generate the desired luminosities for red, green and blue.

Suitable materials for the threshold voltage adjustment layers are those which, when deposited as a layer, at an appropriate thickness, will not conduct until the voltage across the patterned phosphor structure exceeds the threshold voltage for an otherwise identical patterned phosphor structure that does not include the threshold voltage adjustment layer. A suitable material can be chosen by examination of its dielectric constant and dielectric breakdown strength to meet the above condition, with materials having relatively high dielectric constants and dielectric breakdown strengths as compared to those of the phosphor materials being preferable. The materials for the threshold voltage adjustment layer are compatible with those materials that are in contact with them in the patterned phosphor structure, and are chosen from dielectric materials and semiconductors. By semiconductors is meant both intrinsic semiconductors, and semiconductors with deep impurity levels that have effective electronic band gaps that are comparable to, or larger than, the effective band gap of the phosphor material. Examples of suitable materials include binary metal oxides such as alumina and tantalum oxide, binary metal sulfides such as zinc sulfide and strontium sulfide, silica, and silicon oxynitride. The suitability of these materials is dependent on the properties of the interface between the materials and any phosphor materials and the dielectric materials in contact with them. In general, when the phosphor deposit is of a phosphor which is based on zinc sulfide, the preferred threshold voltage adjustment material is a binary metal oxide, most preferably alumina.

Alternatively, or in addition, the means for setting and equalizing the threshold voltages and for setting the relative luminosities comprises forming the first and second phosphor deposits with different thicknesses so as to balance the threshold voltages and the luminosities of the sub-pixel elements. In this case, the overall colour balance can be achieved for a pixel by setting the luminosities for the sub-pixel by using different sub-pixel element areas, for instance by making the sub-pixel elements of the less efficient phosphors wider than the width of the sub-pixel elements with the more efficient phosphors.

The patterned phosphor structure of this invention allows for correct CIE colour coordinates for a full colour display to be achieved for all operating modulation voltage levels, while allowing for the equalizing of the threshold voltages of the sub-pixel elements. The means for setting and equalizing the threshold voltages, and for setting the relative luminosities of the red, green and blue sub-pixels may also comprise, in addition to the threshold voltage adjustment deposits and/or altering the thicknesses of the phosphor deposits, varying one or more of the following in order to set the relative luminosities:

i. the areas of the phosphor deposits; and ii. the concentrations of a dopant or co-dopant in the phosphor deposits.

Preferably, the first and second phosphors are of different host materials, such as a strontium sulfide phosphor or a zinc sulfide phosphor. Generally, a different host material implies that a different element has been introduced to the phosphor host material at an atomic percent greater than about 5 atomic percent. Preferred first and second phosphors are SrS:Ce and ZnS:Mn; SrS:Ce and $Zn_{1-x}Mg_xS$:Mn; or SrS:Ce with layers of both ZnS:Mn and $Zn_{1-x}Mg_xS$:Mn, it being possible for the SrS:Ce to be codoped with phosphorus. These are examples of zinc sulfide and strontium sulfide phosphors which, if they were superimposed, would have a combined emission spectrum which covers the wavelengths of white light (individual visible spectra for ZnS:Mn and SrS:Ce are shown in FIGS. 7 and 8 respectively). Within the scope of the present invention, each of the first and second phosphor deposits may comprise one or more layers of a same or different phosphor for each sub-pixel element, and each of the phosphor deposits may themselves be composed of one or more phosphor compositions (i.e. mixtures of more than one phosphors). As set out below, the phosphor structure of this invention may be provided on one or more layers. For example, in a single layer phosphor structure, as set forth in Example 3, the phosphors can be arranged such that $Zn_{1-x}Mg_xS$:Mn forms the red and green sub-pixel elements, while SrS:Ce forms the blue sub-pixel element. A threshold voltage adjustment layer of a binary metal oxide such as alumina can be provided over the red and green sub-pixel elements to achieve the desired luminous intensity ratios between the sub-pixel elements. Alternatively, as set forth in Example 4, SrS:Ce deposits can be used for the blue sub-pixel elements, and a layer of $Zn_{1-x}Mg_xS$:Mn between layers of ZnS:Mn can be used for the red and green sub-pixel elements. The stacked zinc sulfide phosphor deposits of this embodiment can be formed thick enough to equalize the threshold voltages between the sub-pixel elements. To achieve the desired relative luminosities between the sub-pixel elements, the SrS:Ce deposits for the blue sub-pixels can be made wider than the sub-pixels for red and green. Alternatively, as set forth in Example 5, SrS:Ce deposits can be used for both the green and blue sub-pixel elements, and ZnS:Mn can be used for the red sub-pixel elements. A threshold voltage adjustment layer of a binary metal oxide such as alumina can be used over the red sub-pixel deposits to equalize the threshold voltages.

When two layers of phosphors are used, as in Example 2, the phosphors may be arranged such that SrS:Ce is patterned in a first layer with ZnS:Mn or $Zn_{1-x}Mg_xS$:Mn, and a second layer of SrS:Ce can be formed over the first layer. In this embodiment, the stacked phosphor deposits of SrS:Ce form the blue sub-pixel elements, while the red and green sub-pixel elements are formed by the stacked zinc sulfide phosphor deposit under the SrS:Ce deposit.

Compared to conventional colour by white techniques in which the white light is provided by coplanar, stacked layers of SrS:Ce and ZnS:Mn, the patterned phosphor structure of the present invention has the advantage of being able to provide a thicker layer of SrS:Ce for the blue sub-pixel element, without having an over- or under-layer of ZnS:Mn. This results in increased blue luminance and, since there is no yellow-orange light being emitted in the blue sub-pixels, the filtered light from the SrS:Ce phosphor is a more saturated blue.

The patterned phosphor structure of this invention has particular application in hybrid thick film/thin film AC electroluminescent devices such as described in U.S. Pat. No. 5,432,015, in which the EL laminate is fabricated on a rigid rear substrate, with a thick film dielectric layer below the phosphor structure. AC thin film electroluminescent devices (TFELs) have the disadvantage of generally requiring its thin layers to be planarized, that is of even thicknesses. Such devices generally preclude the ability to use colour phosphor sub-pixels of differing thicknesses. However, using a thick film dielectric layer in an EL laminate in combination with the patterned phosphor structure of the present invention allows one to use different thicknesses of the individual phosphor sub-pixel deposits, so as to optimize the colour coordinates and luminosity of a particular sub-pixel element, while still setting and equalizing the threshold voltages for the sub-pixel elements.

The present invention also extends to novel methods for fabricating the patterned phosphor structure of the present invention. Broadly stated, the invention provides a method of forming a patterned phosphor structure having red, green and blue sub-pixel elements for an AC electroluminescent display, comprising:

selecting at least a first and a second phosphor, each emitting light in different ranges of the visible spectrum, but whose combined emission spectra contains red, green and blue light;

depositing and patterning said at least first and second phosphors in a layer to form a plurality of repeating at least first and second phosphor deposits arranged in adjacent, repeating relationship to each other; and providing one or more means associated with one or more of the at least first and second phosphor deposits, and which together with the at least first and second phosphor deposits, form the red, green and blue sub-pixel phosphor elements, for setting and equalizing the threshold voltages of the red, green and blue sub-pixel phosphor elements, and for setting the luminosities of the red, green and blue sub-pixel elements so that they bear set relative luminosities to one another at each operating modulation voltage used to generate the desired luminosities for red, green and blue; and optionally annealing the patterned phosphor structure so formed.

Preferably the patterning of the at least first and second phosphor is achieved by photolithographic techniques, including the steps of:

a) depositing a layer of the first phosphor which is to form at least one of the red, green and blue sub-pixel elements;

b) removing the first phosphor material in regions which are to define the other of the red, green and blue sub-pixel elements, leaving spaced first phosphor deposits;

c) depositing the second phosphor over the first phosphor deposits and in the regions which are to define the other of the red, green and blue sub-pixel elements; and d) removing the second phosphor from above the first phosphor deposits, leaving a plurality of repeating first and second phosphor deposits arranged in adjacent, repeating relationship to each other.

Novel photolithographic techniques have been developed which are particularly useful in patterning strontium and zinc sulfide phosphors, but which have application to other phosphor combinations. In its most preferred embodiments, the photolithographic methods of this invention utilizes a negative photoresist, and has the advantage of needing only one photo-mask to accomplish the patterning of the red, green and blue sub-pixel elements. In accordance with this method, steps b) through d) include, applying a negative resist to the first phosphor; exposing and developing the resist through a photo-mask in the areas that the first phosphor is to define one or more of the red, green and blue sub-pixel elements; removing the first phosphor as in step b), depositing the second phosphor over the first phosphor deposits and in the regions which are to define the other of the red, green and blue sub-pixel elements; and then removing, by lift-off, the second phosphor from above the first phosphor deposits. Typically in this method, the first phosphor is a strontium sulfide phosphor, most preferably SrS:Ce, which forms the blue sub-pixel elements and optionally the green sub-pixel elements, and the second phosphor is a zinc sulfide phosphor, most preferably ZnS:Mn or $Zn_{1-x}Mg_xS$:Mn, or both, which forms the red, and optionally the green, sub-pixel elements. In accordance with the method, the means for setting and equalizing the threshold voltages and for setting the luminosities of the sub-pixel elements can include adding a threshold voltage adjustment deposit beneath, within or above one or more of the phosphor deposits and/or forming the phosphor deposits with different thicknesses, as set out above. In addition, the means for setting and equalizing the threshold voltages, and for setting the luminosities, of the sub-pixel elements may include varying one or more of:

i. the areas of the phosphor deposits; and ii. the concentrations of a dopant or co-dopant in the phosphor deposits.

The invention also provides a novel photolithographic technique which is particularly useful for patterning a phosphor which is subject to hydrolysis, such as alkaline earth metal sulfide or selenide phosphors. Broadly, the invention provides a method of forming a patterned phosphor structure having red, green and blue sub-pixel elements for an AC electroluminescent display, comprising:

a) selecting at least a first and a second phosphor, each emitting light in different ranges of the visible spectrum, but whose combined emission spectra contains red, green and blue light;

b) depositing a layer of the first phosphor which is to form at least one of the red, green or blue sub-pixel elements;

c) applying a photo-resist to the first phosphor, exposing the photo-resist through a photo-mask, developing the photo-resist, and removing the first phosphor in regions that the first phosphor is to define as one or more of the red, green and blue sub-pixel elements, leaving spaced first phosphor deposits, wherein the first phosphor is removed with an etchant solution comprising a mineral acid, or a source of anions of a mineral acid, in a non-aqueous, polar, organic solvent which solubilizes the reaction product of the first phosphor with anions of the mineral acid, and wherein optionally, prior to removing the first phosphor with the etchant solution, the first phosphor layer is immersed in the non-aqueous organic solvent;

d) depositing the second phosphor material over the first phosphor deposits and in regions which are to define the other of the red, green and blue sub-pixel elements; and e) removing by lift-off, the second phosphor material and the resist from above the first phosphor deposits leaving a plurality of repeating first and second phosphor deposits arranged in adjacent, repeating relationship to each other.

The invention also extends to EL laminates combining, as described above, a rigid rear substrate, a thick film dielectric layer and the patterned phosphor structure, together with front and rear column and row electrodes on either side of the phosphor layer, in which the front and rear column and row electrodes are generally aligned with the phosphor sub-pixel elements, and bandpass colour filter means aligned with the red, green and blue phosphor sub-pixel elements for passing therethrough red, green and blue light emitted from the phosphor sub-pixel elements.

Another aspect of the present invention provides novel and separate selection criteria for barrier diffusion layers and injection layers useful with electroluminescent phosphors, and particularly useful with the patterned phosphor structure and the thick film dielectric of the present invention. Preferably, a diffusion barrier layer is included above the thick film dielectric layer, or if present, above the second ceramic material. The diffusion barrier layer is composed of a metal-containing electrically insulating binary compound which is compatible with any adjacent layers, and which is precisely stoichiometric, preferably varying from its precise stoichiometric composition by less than 0.1 atomic percent, and having a thickness of 100 to 1000 A. Preferred materials will vary with the particular phosphors and the materials in the dielectric layers, but most preferred materials are alumina, silica and zinc sulfide. Preferably, an injection layer is included above the thick film dielectric layer, or if present, above the second ceramic material or the barrier diffusion layer, to provide a phosphor interface. The injection layer is composed of a binary dielectric or semi-conductor material which is non-stoichiometric in its composition and which has electrons in a preferred range of energy for injection into the phosphor layer. The material is compatible with adjacent layers and is preferably non-stoichiometric by greater than 0.5 atomic percent. Preferred materials vary with the particular phosphor and the materials in the underlying dielectric layers, but preferred materials for providing optimum electron energies are hafnia or yttria. There is a compromise between optimum electron injection and compatibility with adjacent layers. As a result, sometimes a non-stoichiometric compound cannot be used as an injection layer.

Another broad aspect of the invention provides a method of synthesizing strontium sulfide, comprising:

providing a source of high purity strontium carbonate in a dispersed form;

heating the strontium carbonate in a reactor with gradual heating up to a maximum temperature in the range of 800 to 1200° C.;

contacting the heated strontium carbonate with a flow of sulfur vapours formed heating elemental sulfur in the reactor to at least 300° C. in an inert atmosphere; and terminating the reaction by stopping the flow of sulfur at a point when sulfur dioxide or carbon dioxide in the reaction gas reaches an amount which correlates with an amount of oxygen in oxygen-containing strontium compounds in the reaction product which is in the range of 1 to 10 atomic percent.

By "dispersed form", in reference to the source of strontium carbonate, as used herein and in the claims, is meant that the strontium carbonate powder particles are exposed to the process conditions substantially uniformly. This can preferably be achieved by using small batches, using volatile, non-contaminating, clean evaporating compounds or solvents which decompose into gaseous products prior to the onset of the reaction, using fluidized beds or tumbler reactors.

The term "phosphor" as used herein and in the claims, means a substance which provides electroluminescence when a sufficient electric field is applied across it, and electrons are injected into it.

The term "white light" when used herein and in the claims, when referring to the combined emission spectra of two or more phosphors, means that white light is emitted when the phosphors are superimposed in a manner such that the light can be filtered to provide red, green and blue light.

The term "compatible" when used herein and in the claims, means that the material is chemically stable to that it does not chemically react with adjacent layers.

The figures showing the thick film dielectric layers and the patterned phosphor structures of this invention are not shown to scale.

DESCRIPTION OF THE PREFERRED EMBODIMENTS

EL Laminate with Isostatic Pressed Thick Film Dielectric

The present invention provides a thick film dielectric layer having increased dielectric strength and dielectric constant, significantly reduced void space, void interconnectedness, porosity and thickness, and significantly improved surface smoothness, when compared to the thick films dielectric layers such as described in U.S. Pat. No. 5,432,015. The smoother surface of the dielectric layer results in an unexpected improvement by providing a higher and more uniform luminosity across an EL display formed therefrom. The improvement is achieved by compressing a thick film dielectric layer prior to sintering, such as by isostatic pressing.

Figure 1:
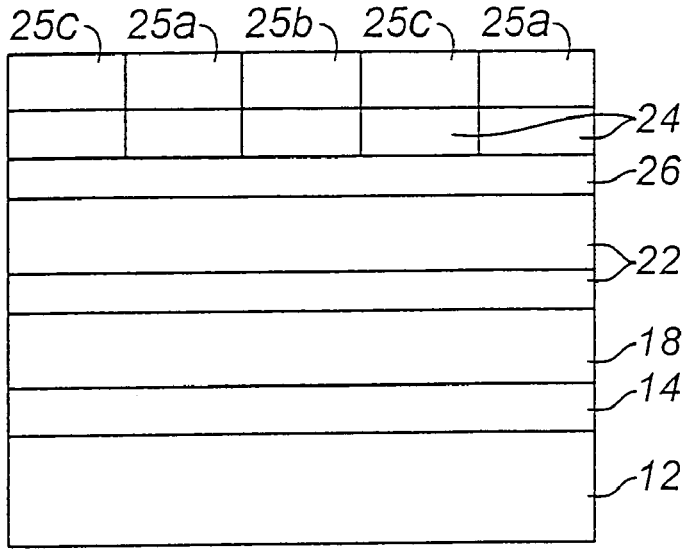
FIG. 1 is a schematic sectional view of an EL laminate having a thick film dielectric of the present invention with conventional colour by white bilayer phosphors and red, green and blue filters.
Figure 2:
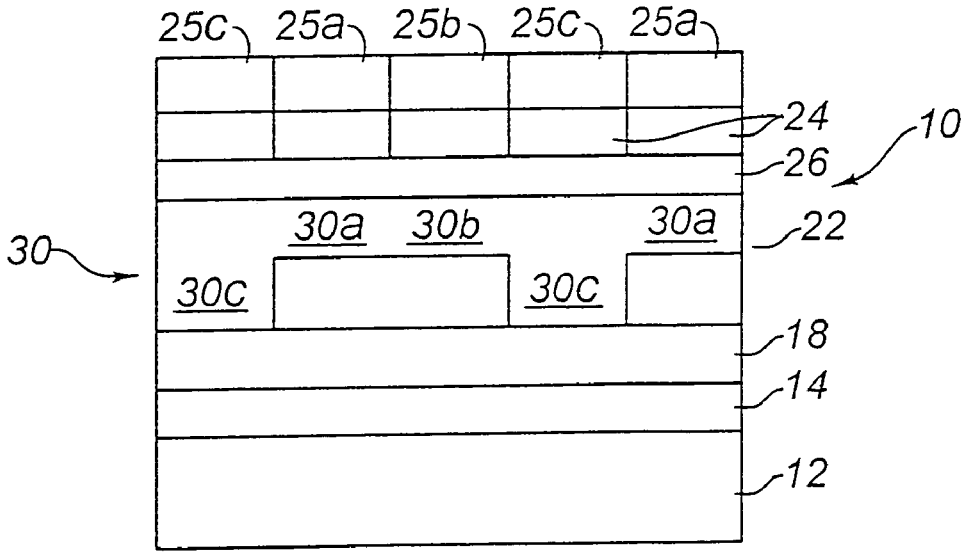
FIG. 2 is a schematic sectional view of an EL laminate having a thick film dielectric of the present invention combined with a two layer patterned phosphor structure of the present invention.
Figure 5:
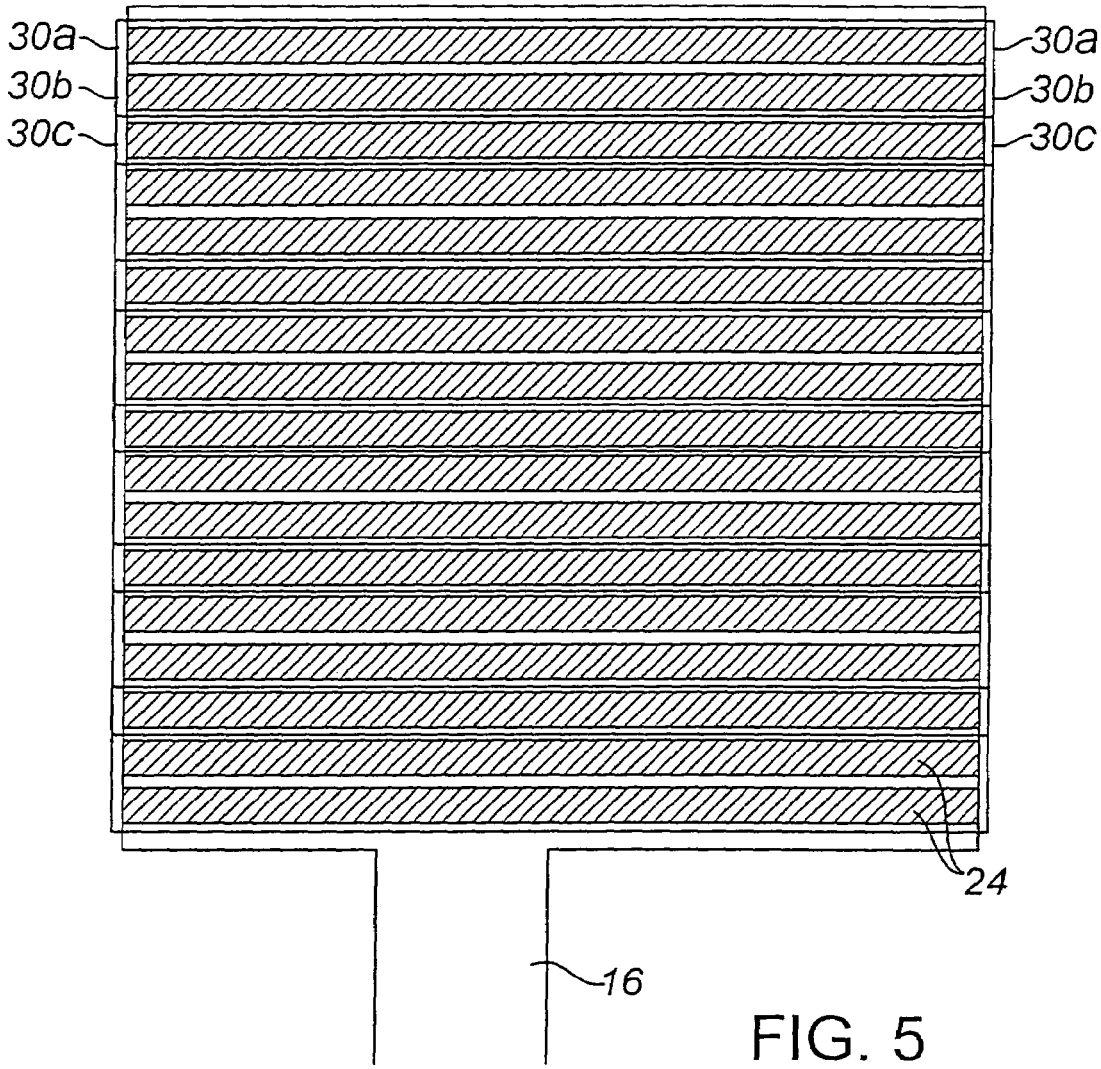
FIG. 5 is a plan view of the ITO column electrode over several pixels, showing alignment with the underlying red, green and blue phosphor sub-pixel elements.
Figure 6:
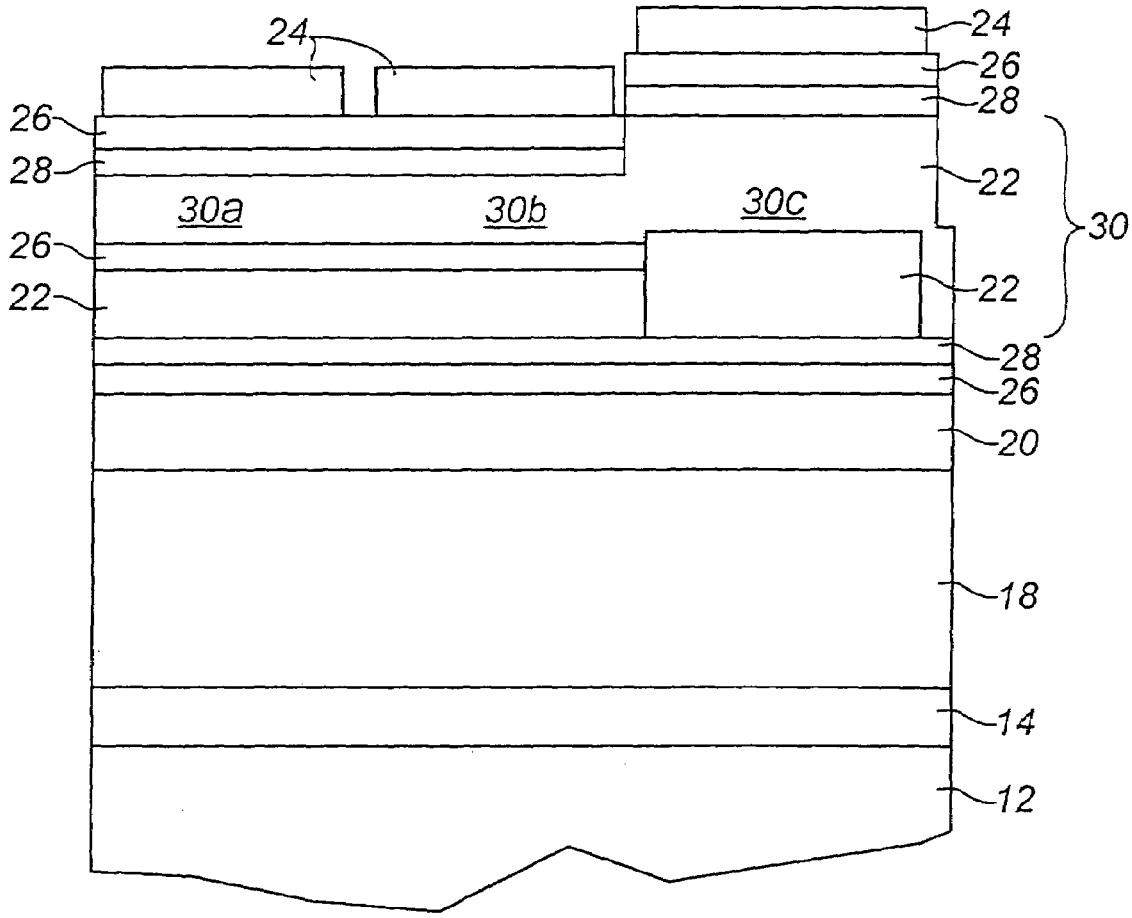
FIG. 6 is a schematic sectional view of a single pixel of an EL laminate with a two layer patterned phosphor structure of the present invention with additional diffusion barrier and injection layers.
Figure 7:
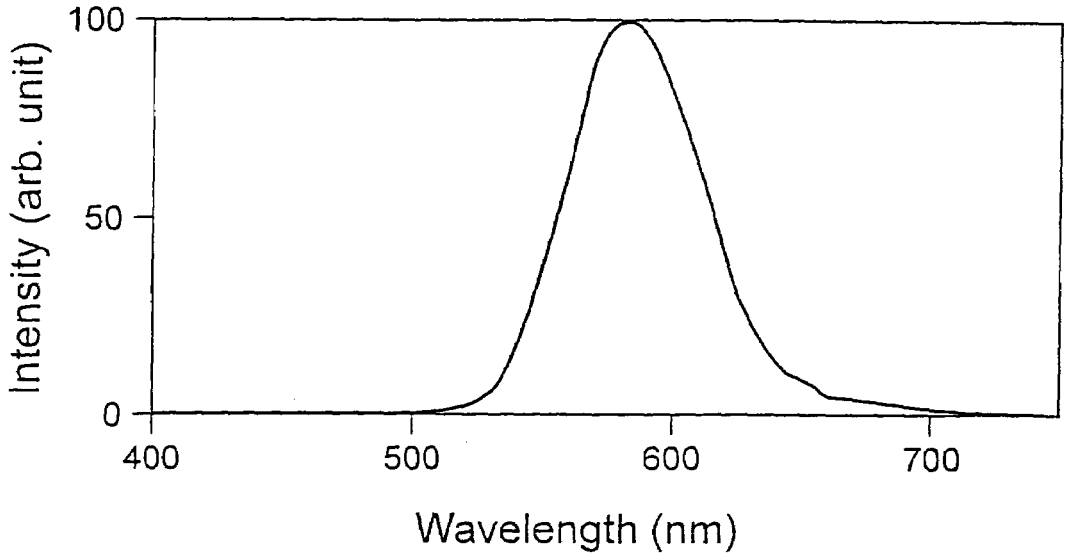
FIG. 7 is a graph of the emission spectrum for ZnS:Mn, plotting intensity in arbitrary units against wavelength in nanometres.
Figure 8:
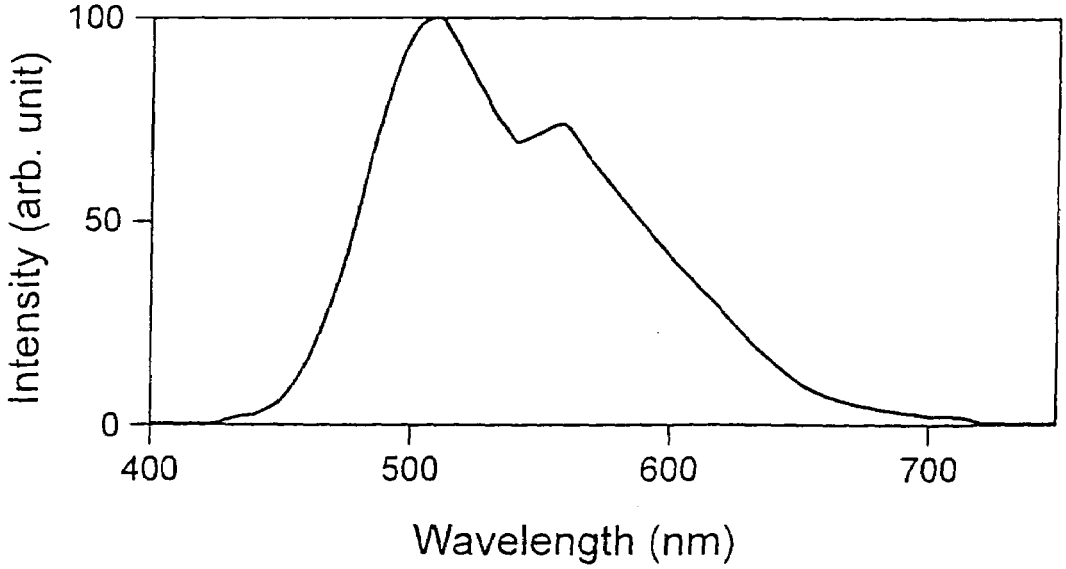
FIG. 8 is a graph of the emission spectrum for SrS:Ce, when synthesized by the process of the present invention, plotting intensity in arbitrary units against wavelength in nanometres.

The thick film dielectric layer will be described with reference to FIGS. 1, 2, 5 and 6. An EL laminate 10 is built from the rear to the front (viewing) side on a rear substrate 12. Preferably, the substrate 12 is a rigid substrate such as a preformed sheet, providing sufficient mechanical strength and rigidity to support the laminate 10. Alternatively, the substrate 12 could be a green tape or the like which will sinter to provide the rigidity for the laminate 10. Thus, the term "rigid substrate" as used herein refers to the substrate after sintering. The substrate 12 is preferably formed from a ceramic which can withstand the high sintering temperatures (typically up to 1000° C.) used in processing other layers of the laminate 10. An alumina sheet is most preferred, having a thickness and rigidity sufficient to support the EL laminate 10. A rear electrode layer 14 is formed on the substrate 12. For lamp applications, the rear substrate 12 and rear electrode 14 might be integral, for example by being provided by a rigid, electrically conductive metal sheet. For display applications, the rear electrode 14 consists of rows of conductive metal address lines centered on the substrate 12 and spaced from the substrate edges. Preferably conductive metal address lines are screen printed from noble metal pastes, as is well known. An electrical contact tab 16 protrudes from the electrode 14, as seen in FIG. 5. The thick film dielectric layer 18 is formed above the electrode 14, and may be formed as a single layer, or as multiple layers. In FIGS. 1 and 2, the layer is shown schematically as one layer, while in FIG. 6, the layer comprises a thicker, first dielectric layer 18, and a thinner, second dielectric layer 20. One or more phosphor layers 22 are provided above the dielectric layer 18, or dielectric layers 18, 20. In FIG. 1, the phosphor is shown as two layers as in a conventional colour by white design. In FIGS. 2 and 6, the phosphor layer 22 is shown to comprise a patterned phosphor structure 30 of the present invention, as is described in greater detail below. Above the phosphor layer(s) 22, there may be provided a third dielectric layer 23. Above the optional third dielectric layer 23 is a front, transparent electrode layer 24. The front electrode layer 24 is shown in FIGS. 1 and 2 as solid, but in actuality, for display applications, it consists of columns of address lines arranged perpendicularly to the row address lines of the rear electrode 14. The front electrode 24 is preferably formed from indium tin oxide (ITO) by known thin film or photolithographic techniques. Although not shown, the front electrode is also provided with an electrical contact. FIGS. 1 and 2 show bandpass colour filter means 25 above the ITO lines, such as polymeric red, green and blue filters 25*a*, 25*b*, and 25*c* respectively, aligned with the ITO address lines. In FIG. 2, these filters 25*a*, 25*b*, and 25*c* are also aligned with red, green and blue phosphor sub-pixel elements 30*a*, 30*b* and 30*c*, in the patterned phosphor structure 30. Also not shown, the EL laminate 10 is encapsulated with a transparent sealing layer to prevent moisture penetration. The EL laminate 10 is operated by connecting an AC power source to the electrode contacts. Voltage driving circuitry (not shown) is well known in the art. The EL laminate 10, incorporating the thick film dielectric layer 18, has application in both EL lamps and displays.

It will be understood by persons skilled in the art that further intervening layers, including for example one or more barrier diffusion layers 26, injection layers 28 or dielectric layers (such as optional second and third dielectric layers 20, 23, respectively) can be included in the laminate 10, some of which are described more particularly below in association with the patterned phosphor structure 30. Thus, throughout this description and in the patent claims, when an EL laminate is defined as including certain layers, additional, intervening layers are not meant to be excluded.

It will be appreciated that, in general, the criteria for establishing the thickness and dielectric constant of the dielectric layer(s) are calculated so as to provide adequate dielectric strength at minimal operating voltages. The criteria are interrelated as set forth below, in respect of a single phosphor layer and a single dielectric layer. In the case of multilayers, such as a two layer phosphor, or the patterned phosphor structure described below, the criteria are adjusted for the multiple layers, for example by using the thickest dimension and average dielectric constant of the entire phosphor layer.

Given a typical range of thickness for the phosphor layer ($d_1$) of between about 0.2 and 2.5 microns, a dielectric constant range for the phosphor layer ($k_1$) of between about 5 and 10 and a dielectric strength range for the dielectric layer(s) of about $10^6$ to $10^7$ V/m, the following relationships and calculations can be used to determine typical thickness ($d_2$) and dielectric constant ($k_2$) values for the dielectric layer of the present invention. These relationships and calculations may be used as guidelines to determine $d_2$ and $k_2$ values, without departing from the intended scope of the present invention, should the typical ranges change significantly.

The applied voltage V across a bilayer comprising a uniform dielectric layer and a uniform non-conducting phosphor layer sandwiched between two conductive electrodes is given by equation 1:

$$V=E_2*d_2+E_1*d_1 \quad (1)$$

wherein:

$E_2$ is the electric field strength in the dielectric layer;

$E_1$ is the electric field strength in the phosphor layer;

$d_2$ is the thickness of the dielectric layer; and $d_1$ is the thickness of the phosphor.

In these calculations, the electric field direction is perpendicular to the interface between the phosphor layer and the dielectric layer. Equation 1 holds true for applied voltages below the threshold voltage at which the electric field strength in the phosphor layer is sufficiently high that the phosphor begins to break down electrically and the device begins to emit light.

From electromagnetic theory, the component of electric displacement D perpendicular to an interface between two insulating materials with different dielectric constants is continuous across the interface. This electric displacement component in a material is defined as the product of the dielectric constant and the electric field component in the same direction. From this relationship equation 2 is derived for the interface in the bilayer structure:

$$k_2*E_2=k_1*E_1 \quad (2)$$

wherein:

$k_2$ is the dielectric constant of the dielectric material; and $k_1$ is the dielectric constant of the phosphor material.

Equations 1 and 2 can be combined to give equation 3:

$$V=(k_1*d_2/k_2+d_1)*E_1 \quad (3)$$

To minimize the threshold voltage, the first term in equation 3 needs to be as small as is practical. The second term is fixed by the requirement to choose the phosphor thickness to maximize the phosphor light output. For this evaluation the first term is taken to be one tenth the magnitude of the second term. Substituting this condition into equation 3 yields equation 4:

$$d_2/k_2=0.1*d_1/k_1 \quad (4)$$

Equation 4 establishes the ratio of the thickness of the dielectric layer to its dielectric constant in terms of the phosphor properties. This thickness is determined independently from the requirement that the dielectric strength of the layer be sufficient to hold the entire applied voltage when the phosphor layer becomes conductive above the threshold voltage. The thickness is calculated using equation 5:

$$d_2=V/S \quad (5)$$

wherein:

S is the strength of the dielectric material.

Use of the above equations and reasonable values for $d_1$, $k_1$, and S provides the range of dielectric layer thickness and dielectric constant. In general, the lower limit of the thickness of the dielectric layer is that it must be sufficiently thick that the dielectric strength of the dielectric layer is higher than the actual electric field present during operation of the device. Generally, the combined thickness of the dielectric layers 18 and 20 can be as low as about 10 μm, with a phosphor layer thicknesses as high as about 2.5 μm.

A method of constructing the thick film dielectric layer 18 will now be described with preferred materials and process steps.

The dielectric layer 18 is deposited by thick film techniques which are well known in the electronics/semiconductor industries. The layer 18 is preferably formed from a ferroelectric material, most preferably one having a perovskite crystal structure, to provide a high dielectric constant compared to that of the phosphor layer(s) 22. The material will have a minimum dielectric constant of 500 over a reasonable operating temperature for the laminate 10 (generally 20-100° C.). More preferably, the dielectric constant of the dielectric layer material is 1000 or greater. Exemplary materials for the layer include $BaTiO_3$, $PbTiO_3$, lead magnesium niobate (PMN) and PMN-PT, a material including lead and magnesium niobates and titanates, the latter being most preferred. Such materials may be formulated from their dielectric powders, or may be obtained as commercial pastes.

Thick film deposition techniques are known in art, such as green tapes, roll coating, and doctor blade application, but screen printing is most preferred. Commercially available dielectric pastes can be used, with the recommended sintering steps set out by the paste manufacturers. Pastes should be chosen or formulated to permit sintering at a high temperature, typically about 800-1000° C. The dielectric layer 18 is screen printed in single or multiple layers. Multiple layers are preferred, following each deposition with drying or baking or sintering in order to achieve low porosity, high crystallinity and minimal cracking. The deposited thickness of the dielectric layer 18 (i.e. prior to pressing) will vary with its dielectric constant after sintering, and with the dielectric constant and thickness of the phosphor layer(s) 22, and of the second dielectric layer 20. The deposited thickness will also vary according to the degree of increased dielectric strength that is accomplished by the subsequent isostatic pressing and sintering steps. Generally the deposited thickness of the dielectric layer 18 will be in the range of 10 to 300 μm, more preferably 20-50 μm, and most preferably 25-40 μm.

Pressing is preferably accomplished by cold isostatic pressing the combined substrate, electrode, dielectric layer part at a high pressure such as 10,000-50,000 psi (70,000-350,000 kPa), prior to sintering the material, while encapsulating the part in a sealed bag with non-stick materials in contact with the dielectric layer 18. The thickness is preferably reduced by 20 to 50%, preferably about 30-40%, with a preferred thickness being about 10-20 μm (all numbers referred to are after sintering). This is found to reduce the surface roughness by about a factor of 10 and the surface porosity by about 50%, after sintering. The final porosity is less than 20% after sintering. The dielectric strength has been shown to be improved by a factor of 1.5 or more after sintering. Dielectric strengths greater than $5.0\times10^6$ are achieved after sintering. EL displays formed from isostatically pressed thick film dielectric layers in accordance with the present invention have demonstrated higher luminosity and more uniform luminosity across the display, and the thick film dielectric layers, once pressed, have a much reduced sensitivity to dielectric breakdown due to printing defects.

A thinner, second dielectric layer 20 is preferably provided above the pressed and sintered dielectric layer 18 to provide a smoother surface. It is formed from a second ceramic material which may have a dielectric constant less than that of the dielectric layer 18. A thickness of about 1-10 μm, and preferably about 1-3 μm is usually sufficient. The desired thickness of this second dielectric layer 20 is generally a function of smoothness, that is the layer may be as thin as possible, provided a smooth surface is achieved. To provide a smooth surface, sol gel deposition techniques are preferably used, also referred to a metal organic deposition (MOD), followed by high temperature heating or firing, in order to convert to a ceramic material. Sol gel deposition techniques are well understood in the art, see for example "Fundamental Principles of Sol Gel Technology", R. W. Jones, The Institute of Metals, 1989. In general, the sol gel process enables materials to be mixed on a molecular level in the sol before being brought out of solution either as a colloidal gel or a polymerizing macromolecular network, while still retaining the solvent. The solvent, when removed, leaves a solid ceramic with a high level of fine porosity, therefore raising the value of the surface free energy, enabling the solid to be fired and densified at lower temperatures than obtainable using most other techniques.

The sol gel materials are deposited on the first dielectric layer 18 in a manner to achieve a smooth surface. In addition to providing a smooth surface, the sol gel process facilitates filling of pores in the sintered thick film layer. Spin deposition or dipping are most preferred. For spin deposition, the sol material is dropped onto the first dielectric layer 18 which is spinning at a high speed, typically a few thousand RPM. The sol can be deposited in several stages if desired. The thickness of the layer 20 is controlled by varying the viscosity of the sol gel and by altering the spinning speed. After spinning, a thin layer of wet sol is formed on the surface. The sol gel layer 20 is heated, generally at less than 1000° C., to form a ceramic surface. The sol may also be deposited by dipping. The surface to be coated is dipped into the sol and then pulled out at a constant speed, usually very slowly. The thickness of the layer is controlled by altering the viscosity of the sol and the pulling speed. The sol may also be screen printed or spray coated, although it may be more difficult to control the thickness of the layer with these techniques.

The ceramic material used in the second dielectric layer 20 is preferably a ferroelectric ceramic material, preferably having a perovskite crystal structure to provide a high dielectric constant. The dielectric constant is preferably similar to that of the first dielectric layer material in order to avoid voltage fluctuations across the two dielectric layers 18, 20. However, with a thinner layer being utilized in the second dielectric layer 20, a dielectric constant as low as about 20 may be used, but will preferably be greater than 100. Exemplary materials include lead zirconate titanate (PZT), lead lanthanum zirconate titanate (PLZT), and the titanates of Sr, Pb and Ba used in the first dielectric layer 18, PZT and PLZT being most preferred.

The next layer to be deposited may be one or more phosphor layers 22, as set out above, and hereinbelow. However, it is possible, within the scope of this invention to include additional layers for diffusion barrier and injectivity purposes, as set out below. Phosphor layers 22 may be deposited by known thin film deposition techniques such as vacuum evaporation with an electron beam evaporator, sputtering etc. Particularly preferred is the patterned phosphor structure of the present invention, as described hereinbelow.

A further transparent dielectric layer (not shown) above the phosphor layers 22 may be included, if desired, followed by the front electrode 24. The EL laminate 10 may be annealed and then sealed with a sealing layer (not shown) such as glass.

Diffusion Barrier Layer

The invention preferably provides a diffusion barrier layer 26 above the thick film dielectric layer(s) 18, 20 and below the phosphor layer(s) 22, particularly the patterned phosphor structure 30 described below. The diffusion barrier layer is preferably provided on both sides of the phosphor layer(s) 22, as shown in FIG. 6. Alternatively, the diffusion barrier layer can be provided within the patterned phosphor structure of this invention, as set out in the examples below.

A good diffusion barrier should be free of cracks and pinholes. These can be eliminated through thermal expansion coefficient matching, stress relief, and conformal coating techniques. There still may be residual diffusion due to grain boundary diffusion which is dependent on the size and nature of the grains comprising the film, or crystal lattice diffusion, which depends on the density of atomic vacancies. Diffusion through pinholes and cracks can be distinguished from grain boundary or lattice diffusion in that it should result in spatial variation of luminosity on the scale of the pinholes or cracks which increases with time rather than spatially uniform time degradation in luminosity. Grain boundary diffusion, which is generally much faster than crystal lattice diffusion, can be minimized by ensuring that the deposited grains in the diffusion barrier layer are as large as possible. This minimizes the areal density of grain boundaries. Chemical inertness of the barrier films in contact with the immediately adjacent layers is also desired to preserve the integrity of the barrier layer.

Phosphor luminosity stability is improved when silica, alumina or zinc sulfide diffusion barrier layers are used, rather than hafnia or yttria. The improvement results even if a thin 100 Å injection layer 28, comprising a different material, is interposed between the barrier layer 26 and the phosphor structure 30. Thus, in accordance with the present invention, the diffusion barrier layer 26 is formed from compounds which have precise stoichiometric compositions. The phase diagrams for the silicon-oxygen, aluminum-oxygen and zinc-sulphur binary systems show that alumina, silica, and zinc sulfide exist only as precisely stoichiometric compounds. By contrast, the yttria-oxygen and hafnium-oxygen phase diagrams show that yttria can exist up to about 1 atomic percent deficient in oxygen, and hafnia can exist up to about 3 atomic percent deficient in oxygen. Thus, these latter two materials, when deposited as coatings, likely have a significant oxygen deficiency. Comparison of the experimental stability data with the stoichiometry of the diffusion barrier layer provides evidence that precise stoichiometric ceramic materials provide effective diffusion barriers.

Based on the above, materials suitable as diffusion barriers can be predicted. Metal-containing electrically insulating binary compounds (dielectrics) that are inert in the presence of adjacent layers and can be deposited without cracks or pinholes and are precisely stoichiometric are preferred materials. The latter aspect can be ascertained by examining binary phase diagrams for materials. Compounds providing the lowest lattice diffusion are those for which the compounds exist only over a very small range of the ratio of their constituent elements, preferably less than 0.1 atomic percent deviation from the stoichiometric ratio. A deviation from the stoichiometric ratio will entail the formation of vacancies in place of the deficient element. Among the materials known in the art as dielectric materials for electroluminescent displays, alumina, silica and zinc sulfide are examples of such stoichiometric compounds.

Injection Layer

The present invention may include an injection layer 28 above the diffusion barrier layer 26, next to the phosphor layer(s) 22, particularly with the patterned phosphor structure 30 described below. The layer is preferably provided on both sides of the phosphor layer(s) 22, in contact with the phosphor layer(s) 22. Alternatively, or as well, the injection layer may be provided within the patterned phosphor structure of this invention, as set out in the examples below.

A feature of this invention is the discovery that the selection criteria for injection layer materials are different than for diffusion barrier materials, so a better combined utility can be obtained by providing the diffusion barrier and injection layer characteristics using two distinct layers for these functions. This does not preclude the possibility that with some thick film dielectric compositions and/or some phosphor compositions, acceptable diffusion barrier and injection characteristics might be found in the same material.

The purpose of this layer is to provide efficient injection characteristics for electrons injected into the phosphor. The purpose is to maximize the number of electrons per unit area of the phosphor that are injected into the phosphor within a preferred energy range so as to maximize the electro-optical energy efficiency associated with the injection of electrons into the phosphor and the subsequent conversion of that energy into light. Generally, this can be accomplished by designing the injection layer phosphor interface so that a maximum number of electrons at the interface are in states with a narrow range of energies that result in the most efficient electro-optic efficiency. The literature reveals data on a large number of such interfaces. With ZnS phosphors, it is found that hafnia and yttria provide higher injection efficiencies than do silica and alumina. With SrS:Ce, it is found that pure ZnS provides a somewhat higher efficiency than does alumina, hafnia, or silica, although this may be because ZnS has a better compatibility with SrS:Ce, making the ZnS layer more of a diffusion barrier layer in its function. In general, the injection layer 28 is a dielectric, binary material which is non-stoichiometric in its composition, that is having greater than about 0.5% atomic deviation from its stoichiometric ratio, so as to have more electrons within a preferred range of energy for better injection efficiency.

Patterned Phosphor Structure

The patterned phosphor structure of this invention is shown generally at 30 in FIGS. 2, 5 and 6. It is described below in the examples, Example 2 being directed to a two layer patterned phosphor structure, and Examples 3, 4 and 5 being directed to a single layer patterned phosphor structure.

An EL laminate 10 incorporating the patterned phosphor structure 30 of the present invention will preferably include all of the layers of the EL laminate 10 as set out above. The description of the patterned phosphor structure 30 is provided for one or a few pixels, but of course multiple pixels are repeated cyclically across the EL laminate 10 of an EL display. In that respect, three sub-pixels of row and column electrodes together form a single pixel, aligned with the red, blue and green phosphor sub-pixel elements 30*a*, 30*b* and 30*c* respectively, and the red, blue and green filters 25*a*, 25*b*, and 25*c* respectively.

The patterned phosphor structure 30 is formed on the dielectric layer 18 or 20, or more preferably above any barrier diffusion and injection layers 26 and 28, by depositing and patterning two or more phosphors emitting light in different ranges of the visible spectrum in at least one layer to form a plurality of repeating phosphor deposits arranged in adjacent, repeating relationship to each other. The patterning may be accomplished by photolithography or by shadow mask patterning, however photolithography is preferred. In accordance with this invention, a photolithography method with a negative photoresist and lift-off procedure involving as few as one photo-mask is used. This process is particularly advantageous for patterning moisture sensitive strontium sulfide phosphors along with zinc sulfide phosphors, but has application for other colour phosphors, particularly for alkaline earth metal sulfide or selenide phosphors which are subject to hydrolysis.

A first layer of a first phosphor is deposited by known techniques to form one or more of the red, green or blue sub-pixel elements. Preferably, the first layer is a strontium sulfide phosphor, to form the blue, or the blue and the green sub-pixel elements. A negative photoresist is applied to this first phosphor layer, followed by exposure through a photomask designed to expose either the blue, or the blue and green, sub-pixel elements.

A negative resist is used due to its superior stability at the elevated temperatures to which the resist is exposed during subsequent processing, and its ability to be used with non-aqueous solutions. A negative resist based on polyisoprene is preferred. Alternative negative resists such as those based on polyimide can also be used, as can positive resists if they are first subject to deep ultraviolet curing before being exposed to high temperature. Positive resists that can be exposed using e-beam writing rather than light exposure may also be used, particularly if very high resolution patterning is desired.

The exposure process requires the use of only one mask through all of the phosphor pattering steps, simplifying the process over multi-mask processes commonly used in photolithography. Negative resists have the property that they can be rendered insoluble in developer chemicals when they are exposed to light. Accordingly, the patterning mask is designed to allow exposure of the resist over the regions corresponding to the blue, or the blue and green, sub-pixel elements.

Following exposure, the resist is developed, rinsed and de-scummed, prior to acid etching to remove the phosphor in the regions which are to form the red and green, or the red, sub-pixel elements. Etching is preferably preceded by first immersing in a polar, non-aqueous, organic solvent, preferably methanol, in order to permeate the pores of the phosphor. Etching is accomplished with an etchant solution which includes a mineral acid, or a source of anions of a mineral acid, in a non-aqueous, polar, organic solvent which solubilizes the reaction product of the first phosphor with anions of the mineral acid. By non-aqueous is meant a solvent which has less than 1% by volume water, preferably less than 0.5% water. Mineral acids include hydrofluoric acid, hydrochloric acid, sulfuric acid, nitric acid, phosphoric acid, and hydrobromic acid, or mixtures thereof, with hydrochloric acid and phosphoric acid being most preferred. The non-aqueous, polar, organic solvent is most preferably methanol. The mineral acid is preferably used from its concentrated form in the etchant solution in order to limit the amount of water which is included. Generally, the amount of concentrated mineral acid is in the range of 0.1 to 1% by volume. The part with the first phosphor is immersed in this etchant solution to dissolve the areas of unexposed strontium sulfide. Etchant solutions of 0.5% HCl in methanol, or 0.1% HCl and 0.1% $H_3PO_4$ in methanol, are exemplary of preferred embodiments.

A second phosphor, or optionally a second and a third phosphor, for the red and green, or the red, sub-pixel elements is deposited over both the first phosphor, overlaid with the exposed resist, and the regions where the first phosphor has been removed. Preferably the second, or second and third, phosphors are zinc sulfide phosphors. At this point, additional layers such as injection layers, or threshold voltage adjustment layers may be deposited above the second, or above the second and third, phosphors. Alternatively, such additional layers may be deposited before the first phosphor deposition, or after removal of the first phosphor, depending on their desired placement. A still further alternative is to deposit such additional layers between the second and third phosphors. This photolithographic method allows for a wide degree of flexibility.

The second phosphor layer, and any third phosphor or additional layers, are selectively removed from the regions above the first phosphor by a lift-off step. Preferably a solvent solution is used which is predominantly a polar, aprotic solvent, and which will allow removal of the resist in a time which is sufficiently fast that it does not cause significant hydrolysis of the phosphors. For lift-off of a zinc sulfide phosphor, a solution of a minor amount (up to 50%, preferably about 5 to 20%, most preferably about 10% by volume) of methanol in toluene is particularly preferred. Other non-aqueous, polar, aprotic solvents such as acetonitrile, diethyl carbonate, propylene carbonate, dimethyl ether, dimethyl formamide, tetrahydrofuran and dimethyl sulfoxide might also be used, depending on the particular phosphors involved. The particular solvents used are chosen to minimize hydrolysis of the phosphors while still removing the resist in a reasonable time period.

This first layer of the patterned phosphors may then be covered by another layer of a phosphor material which is the same as or different from the first, second, or third phosphors, in order to achieve the desired threshold voltages and luminosities for the sub-pixel element. Alternatively, the threshold voltages and the luminosities for the sub-pixel elements may be set with appropriate threshold voltage adjustment layers deposited below, between or above the phosphors. In addition, or as a further alternative, the thicknesses of the phosphor deposits may be varied to equalize the threshold voltages and to set the desired relative luminosities of the sub-pixel elements. A still further or additional alternative to the above is to adjust one or more of the areas of the sub-pixel elements, or the compositions of the phosphors and dopants, in order to achieve the desired threshold voltages and relative luminosities of the sub-pixel elements.

The photolithographic method of this invention allows great flexibility in the adjustment of the above parameters and/or layers in order to individually set the desired threshold voltages and relative luminosities of the sub-pixels elements.

Above the patterned phosphor structure 30 may be formed a second dielectric layer 28 and a patterned transparent conductor to define column electrodes 24 perpendicular to the row electrodes 14 positioned beneath the phosphor structure 30.

When $Zn_{1-x}Mg_xS$:Mn is used as a phosphor, the value of x is preferably between about 0.1 and 0.3, more preferably between about 0.2 and 0.3. When SrS:Ce is used as a phosphor, it may be codoped with phosphorus.

a) Factors Affecting Pixel Performance

This section is included to provide guidance for the criteria relating to the choice of phosphors and the particular thicknesses to be used in the sub-pixel elements. In the following section, the thickness criteria are discussed for particular preferred, and exemplary phosphors.

A high pixel energy efficiency is required to obtain a high luminosity and a high overall energy efficiency for an electroluminescent display. The pixel energy efficiency is defined as the ratio of light power within the desired wavelength range radiated from the surface of a pixel divided by the electrical power input to the pixel. The light power, expressible in watts per square meter, can be directly related to the luminosity of the pixel expressed in candelas per square meter using well known relationships. These relationships are a function of the angular distribution of light from a sub-pixel as well as a wavelength factor accounting for the sensitivity of the human eye to different colours or wavelengths of light. The following discussion details the factors that affect the pixel energy efficiency. This efficiency can be expressed as the product of several independent factors. These are defined here as the electron injection efficiency, the electron multiplication efficiency, the activator excitation efficiency, the radiative decay efficiency and the light extraction efficiency. Four of these five factors are dependent on the thickness of the phosphor film as discussed below.

1. Electron Injection Efficiency

Figure 9:
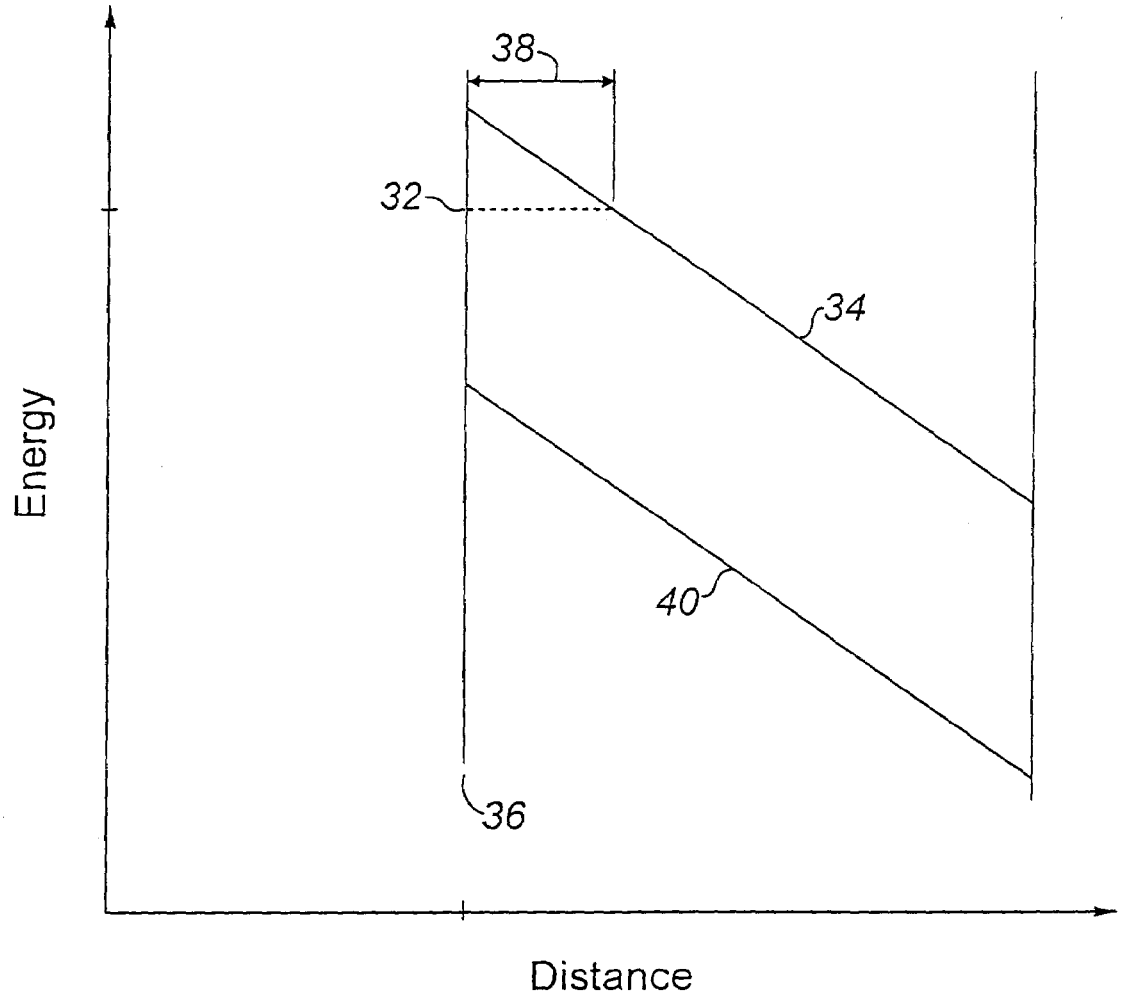
FIG. 9 is a schematic plot of energy against distance to illustrate phosphor electron bands in the presence of an electric field.

The electron injection efficiency is defined herein as the ratio of the energy flux of hot electrons injected into the phosphor layer of a display sub-pixel to the electrical power input to that sub-pixel. Generally, injection occurs by electrons tunnelling into the phosphor from surface states at or near the interface between the phosphor and the immediately adjacent dielectric layer. With reference to the numbers in FIG. 9, typically, the energy of the electrons in the surface states, shown at 32, lies below the bottom of the electron conduction band in the phosphor material. When an electric potential is applied across the phosphor, the conduction band bottom, shown at 34, decreases linearly with distance away from the interface, shown at 36. The slope of this linear decrease is proportional to the applied potential, and inversely proportional to the phosphor thickness. Tunnelling will occur if the distance (shown as the tunneling distance 38), between the interface 36 and the first point at which the bottom of the conduction band 34, is approximately equal to the energy of an electron in a surface state 32, and is sufficiently small, generally of the order of a few nanometers. This distance can be reduced to the point where tunnelling occurs by increasing the potential across the phosphor layer or decreasing the phosphor thickness for a fixed potential.

Not all of the injected electrons that are injected will be "hot" electrons. In general, there will be a distribution of energies for the surface electrons that can be injected into the phosphor layer. If the energy difference between a surface electron and the bottom of the conduction band is too small, the electron will be injected into the phosphor with a low energy. Low energy or "cold" electrons tend to interact strongly with the phosphor host material and lose their energy without light being generated. Thus, the fraction of hot or light-generating electrons is related to the energy distribution of surface electrons. The surface electron energy distribution is a function of the phosphor and immediately adjacent dielectric materials used. The electron injection model described above can be distorted by the presence of trapped positive or negative charges within the phosphor layer that can produce deviations from the assumed constant electric field across the phosphor. Nevertheless, the general principles for optimizing the hot electron injection efficiency by selecting an appropriate phosphor thickness remain the same.

For a defined potential across the phosphor layer the electron injection efficiency in general should decrease as a function of phosphor thickness because the injection tunnelling probability will decrease due to decreased electric field strength. The potential across a sub-pixel is normally selected in terms of the voltage and current delivery capability of the electronic circuitry used to operate the sub-pixel and the threshold voltage desired for sub-pixel operation. The fraction of this voltage across the phosphor layer is a function of the thickness and dielectric constant of the phosphor and of the dielectric layers used in conjunction with the phosphor layer, as previously discussed. The injection efficiency decreases when the tunnelling probability drops because a larger fraction of the power input to the pixel is dissipated due to resistive and dielectric hysteresis losses in the dielectric layers of the pixel as well as resistive loss in the conductors supplying electrical current to the sub-pixel. These sources of loss can be minimized through the use of dielectric layers having a high dielectric constant as discussed above.

2. Electron Multiplication Efficiency

The electron multiplication efficiency is defined here as the energy conversion efficiency associated with the generation of a large number of hot electrons through the electron multiplication process described below from a lesser flux of injected hot electrons Electron multiplication depends on a phenomenon whereby an electron accelerated in the phosphor host material in response to the applied electric field can cause a second electron to be extracted from the valance band where it is immobile into the conduction band. The second electron can then also be accelerated in response to the applied field. For this to occur, the initial electron must have energy at least equal to twice the band gap energy above the top of the valence band, shown at 40 in FIG. 9. Electron multiplication is a cascading process that can produce a large number of accelerating electrons from a few injected electrons. The multiplication factor increases as the applied potential across the phosphor layer is increased. For a fixed potential across the phosphor the electron multiplication efficiency should be highest for relatively thin phosphor layers where the electric field strength is relatively high and the distance electrons travel between multiplication events is relatively low. The reduced distance of travel lowers the probability that the electrons will scatter from the phosphor host crystal lattice so that they lose energy and fall out from the cascading process. Electron multiplication is useful particularly if the density of injection electrons is relatively low.

The electron multiplication and charge injection processes will be affected by positive charges (holes) created when electrons are promoted from the valence band to the conduction band of the phosphor host material. These charges should be able to migrate in response to the applied potential in the opposite direction, to the interface from which the initial electrons were injected. Facilitation of this migration minimizes the buildup of charge within the phosphor film that will tend to distort the electric field within the phosphor that is induced by the applied potential. The hole-migration rate may be increased if the phosphor layer is relatively thin and the driving electric field is relatively large.

3 Activator Excitation Efficiency

The activator excitation energy is defined here as the fraction of hot electrons that cause an electron on activator atoms to be promoted to a more energetic or excited state.

The light emitting centers or activators in a phosphor are dopant atoms dispersed throughout the host material, the electrons of which are promoted to an excited state when a hot electron collides with them. The electrons in the excited atoms then can return to their normal ground state, causing a photon to be emitted. The excitation process is called activation. The luminosity of a phosphor is proportional to the rate at which photons are generated. This rate is in turn proportional to the flux of hot electrons incident on the dopant atoms, which is controlled by the factors discussed in the previous paragraphs. The efficiency of the activation process is related to the cross section presented by the dopant atoms to the incident hot electrons. This efficiency is mostly determined by the local environment of the dopant atoms in the host material of the phosphor, and is not likely strongly affected by the phosphor thickness.

4. Radiative Decay Efficiency

The radiative decay efficiency is defined herein as the fraction of excited dopant atoms that decay to their ground state, emitting a photon with an appropriate energy to contribute to sub-pixel luminosity.

When a dopant atom is activated, it can return to its initial or ground state by a variety of processes, of which only some result in the generation of a photon contributing to the phosphor luminosity. The photon must have an energy corresponding to the wavelength range for the colour of light desired (red, green or blue) to be counted as effectively contributing to the luminosity. One of the factors affecting the radiative decay efficiency is the local electric field present at the dopant atom site. This in turn relates back to the phosphor thickness, as well as to the total potential across the phosphor layer. In general, if the electric field strength is too high, a process called field quenching occurs, whereby the excited electrons in the dopant atom have an increased probability of being removed from that atom and injected into the conduction band of the host material. The removed electrons eventually lose their energy in a collision process that does not result in photon emission, resulting in a reduction in radiative decay efficiency. The presence of a high, externally applied electric field at the dopant atom site might also alter the wavelength of any emitted photons, moving it in or out of the range where the photon contributes to the desired colour.

Generally, the radiative decay efficiency should be highest when the local electric field strength is below the value at which field quenching can occur. For a fixed potential across the phosphor layer, the field strength is reduced if the phosphor thickness is increased.

5. Light Extraction Efficiency

The light extraction efficiency is defined herein as the fraction of photons within the required energy range to contribute to sub-pixel luminosity generated within the phosphor that are transmitted through the front surface of a sub-pixel, thus directly contributing to useful luminosity.

Not all of the light generated by activators within the phosphor material is extracted from the phosphor layer to provide useful luminosity. Typically, some of the light generated within the phosphor may reflect internally from the phosphor surfaces, or from any other interface within the sub-pixel structure. There may be multiple reflections of this nature before the light is transmitted through the upper surface of the sub-pixel structure thus contributing to useful luminosity. The longer the optical path that the photons travel before escaping the pixel structure, the greater is the probability that the light will be absorbed within the sub-pixel structure, causing a reduced light extraction efficiency. Even if there are no internal reflections, light may still be absorbed along the direct path between the activator atoms from which the light originates and the outer surface of the phosphor. The probability of absorption increases as the thickness of the phosphor layer is increased, so the light extraction efficiency, from this standpoint, is decreased when the phosphor thickness is increased. The probability of reflections (reflection coefficient) at the phosphor surfaces is related to the difference in the index of refraction of the phosphor material and the adjacent layers in the sub-pixel structure. This is an intrinsic property of the materials, and is not dependent on thickness. However, if the phosphor thickness should become sufficiently thin as compared to the wavelength of light in that material, then the reflection coefficient may have a dependence on individual layer thickness within the phosphor and other layers that are part of the sub-pixel structure. Any such dependence is not readily predicable from theory, but can be experimentally determined.

6. Total Pixel Energy Efficiency

The total pixel energy efficiency is the product of the five efficiency factors defined and described in the preceding paragraphs. For some of these factors, efficiency is an increasing function of phosphor layer thickness, and for others it is a decreasing function of phosphor thickness. Achieving an overall efficiency optimization is a complex process involving many parameters, and in the end the optimum thickness of individual phosphors in a sub-pixel structure may be determined experimentally, using the considerations discussed above as a guide. Typically, the pixel energy efficiency will have a maximum as a function of phosphor thickness due to the trade off between the five contributing factors. The shape of this efficiency curve is dependent on many parameters, and the overall optimum phosphor thickness and operating voltage to achieve maximum luminosity and electro-optic efficiency can be determined experimentally, using the scientific principles discussed above as a guide.

b) Criteria for Selecting Phosphor Deposit or Threshold Voltage Adjustment Layer Thicknesses and Areas of Sub-pixels The performance of a pixel employing a patterned phosphor structure can be optimized through a judicious choice of design parameters. These parameters include the compositions of the phosphors and the dopant concentrations, the relative areas of the sub-pixels and the thickness of the phosphor deposits and any additional threshold voltage adjustment deposits of dielectric or semiconductor materials incorporated into one or more of the sub-pixel elements for the purpose of ensuring that the relative luminosities of the sub-pixel elements bear set ratios to one another at each modulation voltage used, to enable colour balance control for a pixel by setting the colour coordinates for the sub-pixels, most preferably enabling gray scale capability, for full colour. Optimum parameters can be selected by following the steps outlined below:

1. Select the sub-pixel areas, choosing between:
   i. Equal areas for each sub-pixel
   ii. Equal areas for each sub-pixel, but including more than one sub-pixel for one or two of the three colours
   iii. Variable areas selected to maximize total luminosity with the required colour balance, but constrained to a value between a minimum and a maximum width.
   iv. Variable areas for each sub-pixel and more than one sub-pixel for one or two of the three colours.

The selection of the preferred options is on the basis of a trade-off between achieving the maximum possible luminosity, achieving the desired colour coordinates for the sub-pixels using appropriate red, green and blue filters, achieving gray scale operation, avoiding difficulties with uneven electrical loading of the row and column drivers and ease of fabrication considerations. The selection of more than one sub-pixel for a single colour rather than a single sub-pixel with increased area is governed by a desire to keep the load impedance seen by row or column drivers above a critical value below which the luminosity of some sub-pixels may be lower than intended due to a voltage drop caused by excessive current flow from the driver. In this situation, gray scale fidelity may be impaired and undesirable image artifacts may be created. If the load impedance of a set of sub-pixels driven by one driver is too low, the load can be shared by more than one driver by selecting more than one sub-pixel per colour. Independently addressable sub-pixels within a single pixel can be created by incorporating one or more rows and one or more columns within the pixel. One possible sub-pixel arrangement is a "quad-pixel" containing four pixels defined by the intersection of each of two columns and two rows. In this arrangement, two of the pixels can be assigned to one colour.

2. Determine the phosphor deposit thicknesses for the performance limiting sub-pixel using the steps given below. These steps are independent of the choice of sub-pixel options i. to iv. above.
   A. Determine the optimum threshold and total driving voltages for the pixel. This choice is governed by considerations of the available driver electronics, the desired sub-pixel luminosities and the desired energy efficiency. Generally, the highest feasible threshold and total voltage will give the highest luminosity. Typically, threshold voltages of up to 200 V and modulation voltages up to 60 V can be provided, giving a maximum operating voltage of about 260 V. It is desirable that the threshold voltage for all sub-pixels be equal so that the maximum threshold voltage can be applied to the rows, consistent with having no emission from any pixel when zero modulation voltage is applied. This facilitates full gray scale control and minimizes overall power consumption as discussed above.
   B. Determine a thickness of each phosphor deposit to be used for each sub-pixel that will give the desired threshold voltage, consistent with providing the desired colour coordinates and luminosity. It one embodiment of this invention a two layer phosphor structure is used (see Example 2). There, it is found experimentally that a deposit of SrS:Ce, with 0.1% Ce dopant, with a thickness between about 1.4 and 1.8 μm is appropriate for the blue sub-pixel for the voltages given above. Co-doping of this phosphor with phosphorous to provide charge compensation for the cerium may have the effect of increasing the threshold voltage by about 25%. Two layers of phosphor deposits comprising about 0.7 to 0.9 μm of SrS:Ce and about 0.35 to 0.45 μm of ZnS:Mn are appropriate for the red and green sub-pixels at similar voltages. The correct colour coordinates can be achieved through the use of appropriate filters for red and green. In other embodiments, a single layer of patterned phosphor deposits is used. In Example 3, it is found experimentally that an SrS:Ce deposit of 1.2 to 1.4 μm is appropriate for the blue sub-pixels, while a deposit of $Zn_{1-x}Mg_xS$:Mn of 0.3 to 0.5 μm is appropriate for the green and red sub-pixels. In Example 4, the red and green sub-pixels can be formed from three stacked phosphor deposits of 0.4 to 0.6 μm of $Zn_{1-x}Mg_xS$:Mn sandwiched between two 0.08 to 0.1 μm layers of ZnS:Mn. In Example 5, a deposit of 1.2 to 1.4 μm of SrS:Ce can provide both the green and blue sub-pixels, while a 0.4 to 0.5 μm deposit of ZnS:Mn can provide the red sub-pixels. In the foregoing, the suggested compositions and thickness ranges are dependent on the physical and electroluminescent properties of the phosphor layers, as well as on the electrical characteristics of the threshold voltage adjustment layers and any additional dielectric layers, and so variations may be expected, depending on the specific properties of the materials employed.

C. Identify which of the sub-pixels defined above will have the lowest luminosity relative to the required luminosity to give the desired pixel colour balance. The thickness of each phosphor deposit for this sub-pixel is then selected to be that determined for this sub-pixel in step B.

3. Determine the area of the remaining sub-pixels and the thickness of their phosphor and other threshold voltage adjustment layers. If the option of equal sub-pixel areas has been selected, steps D and E should be followed. If equal areas and more than one sub-pixel for at least one colour is selected, steps J and K should be followed, provided that the sub-pixel dimensions determined fall between the specified minimum and maximum values. If variable areas have been selected using steps J and K, and the dimensions do not fall between the specified minimum and maximum values, steps L and P should be followed instead.

D. find the thickness of each of the phosphor deposits for each remaining sub-pixel that gives the desired colour coordinates and the desired luminosity relative to the performance limiting sub-pixel. The threshold voltages for these sub-pixels should in general be lower than that for the performance limiting sub-pixel.

E. Determine the thickness of a dielectric or semi-conductor deposit required for increasing the threshold voltage for these sub-pixels to the threshold voltage of the performance limiting sub-pixel. This deposit can be disposed under, over, or in the case where more than one phosphor deposit is employed, between phosphor deposits, with the order of the deposits selected on the basis of ease of fabrication considerations, or on the basis of physically isolating incompatible deposits from one another.

F. Decide which colours will have more than one sub-pixel. This will typically be the performance-limiting colour.

G. With the increased number of sub-pixels for the original performance limiting colour, re-assess which colour is the performance limiting one, and select the thickness of its phosphor deposits as outlined in step B.

H. Determine the thickness of the phosphor deposits for the remaining sub-pixels to give the desired luminosities relative to the performance limiting sub-pixel.

I. Determine the thickness of a threshold voltage adjustment layer required to increase the threshold voltage of the remaining sub-pixels relative to that of the performance limiting sub-pixel.

J. Select the thickness of all phosphors to make their threshold voltage equal with reference to steps B and C.

K. Adjust the sub-pixel areas to achieve the desired relative luminosities.

L. Calculate the sub-pixel areas to achieve the desired relative luminosities.

M. Determine which areas require dimensions outside of the specified range, and adjust them up or down accordingly.

N. Taking into account the adjusted sub-pixel areas, reevaluate which colour is the performance limiting colour, and select the thickness for each of its phosphor deposits as determined in step B.

O. Select the thickness of the remaining sub-pixels to achieve the desired relative luminosities.

P. Select a dielectric or semiconductor deposit to adjust the threshold voltages of the remaining sub-pixels to that of the performance limiting sub-pixels as in step E.

c) Exemplary Application of Selection Criteria

Application of the above selection criteria is shown below for a two layer phosphor structure in which the threshold voltage and luminosities are set by a layer of SrS:Ce above a patterned layer of SrS:Ce and ZnS:Mn.

1. Total SrS:Ce Thickness

The combined thickness of the SrS:Ce layers on the blue sub-pixel is determined on the basis of the desired threshold voltage for the display. This is in turn dictated by the row and maximum column voltages and concomitant currents for full luminosity that can be provided by the display driver electronics. Typically, row drivers can provide a maximum 200 V output for the threshold voltage and column drivers can provide a maximum 60 V modulation voltage. It is found experimentally that a 0.1% cerium doped strontium sulfide layer with a thickness between about 1.4 and 1.8 microns is appropriate for these voltages. In some cases the strontium sulfide is co-doped with phosphorus in the same molar proportion as cerium to provide charge compensation. Charge compensation may be provided because, relative to the host atomic species, cerium is deficient one electron per cerium atom. Phosphorus has one excess electron per phosphorus atom and can compensate for the missing electron from the cerium. Phosphorus induced charge compensation is thought to inhibit spontaneous charge compensation through the creation of atomic vacancies that can change the properties of the phosphor, and possibly reduce the electroluminescent efficiency of the phosphor. Phosphorus co-doping may have the effect of increasing the threshold voltage by about 25% and so this difference must be taken into account in establishing the strontium sulfide layer thickness.

2. The ZnS:Mn Thickness

The ZnS:Mn layer thickness on the red and green pixels is determined on the basis of providing the correct red to green to blue luminosity ratio of 3:6:1 at full luminosity. Generally, the limiting luminosity from ZnS:Mn is the green luminosity. The patterned phosphor structure of this invention makes use of the combined green emission from the ZnS:Mn and the SrS:Ce covering the green sub-pixel. Accordingly, the ZnS:Mn thickness is determined from the required blue to green ratio of 1:6 at the total applied voltage (sum of the threshold and modulation voltage) for full luminosity. The green emission is also dependent on the thickness of the second SrS:Ce layer overlying the green sub-pixel, so the thickness of this layer is dependent on the choice of the thickness of the first SrS:Ce layer as discussed below. The net green luminosity is also dependent on the optical absorption in the filter used to obtain satisfactory colour coordinates for the green pixel. Accordingly, some experimental optimization is required to select the ZnS:Mn thickness. For the total applied voltage in this example, a ZnS:Mn layer thickness in the range of 0.35 to 0.45 μm is satisfactory. The correct red luminosity can be obtained by selecting an appropriately attenuating red filter.

3. The First SrS:Ce Layer Thickness

The thickness of the first SrS:Ce layer is chosen to match the threshold voltage for the three sub-pixels and thus depends on the ZnS:Mn thickness chosen above. It is desirable that the threshold voltages be equal so that the maximum threshold voltage can be applied to the rows, consistent with having no emission from any pixel when zero modulation voltage is applied. This facilitates full gray scale control and minimizes overall power consumption as discussed above. The optimum thickness for the first SrS:Ce layer is in the range of about 0.7 to 0.9 for this example. In all of the foregoing, the specified ranges are dependent on the physical and electroluminescent properties of the phosphor layers, as well as on the electrical characteristics of the encapsulating dielectric layers, and so variations may be expected, depending on the specific properties of the materials employed.

d) Patterned Phosphor Fabrication Process

The patterned phosphor structure 30 is described below in Examples 2-5, with reference to preferred materials and conditions, to fabricate a pixel having red, green and blue sub-pixels phosphor elements 30*a*, 30*b*, and 30*c* with component red, green and blue colours. The process and structure are not limited by these examples, but are amenable to the fabrication of EL displays with different construction and having a wide variety of pixel sizes, ranges of pixel counts, and types of phosphors. The patterned phosphor structure is described in combination with preferred thick film dielectric layers, phosphors, threshold voltage adjustment layers, barrier diffusion layers, and injection layers, as described above.

The present invention is further illustrated by the following non-limiting examples.

EXAMPLES

Example 1

Isostatically Pressed Thick Film Dielectric Layer

A first layer of Heraeus CL90-7239 (Heraeus Cermalloy, Conshohocken, Pa.) high dielectric constant paste was screen printed using a 250 mesh screen having a 1.6 μm wire diameter. The high dielectric constant material in the paste was PMN-PT. The printed paste was dried for between 30 and 60 minutes at 150° C., with the longer times for a more heavily loaded oven. A second layer of the same material was printed over the baked first layer and then baked in at 300° C. for 30 min. The thickness of the combined layers at this point was about 26 μm. The entire structure was next cold isostatically pressed (CIPped) using a cold isostatic press at 350,000 kPa (50,000 psi). To ensure adequate pressing and to develop a relatively smooth surface on the dielectric layer, a sheet of aluminized polyester, with the aluminized surface in contact with the dielectric, was laid over the dielectric surface. A further two sheets of plastic bagging material were then folded around the part, so as to isolate the part from an outer, compliant sealing bag to prevent the sealing bag from tearing. The sealing bag was evacuated of air and hot sealed. The bag was isostatically pressed at the indicated pressure and held at that pressure for no more than 60 seconds. After pressing the part was removed from the bag and fired in a belt furnace using a typical thick film temperature profile with a peak temperature of 850° C. After pressing and firing the dielectric material was essentially non-porous. The thickness of the dielectric layer at this point was in the range of 15-20 μm, typically 16 μm.

To test the compressed thick film dielectric layer, it was fashioned into a capacitor between 1 $cm^2$ metal electrodes evaporated onto its surface. An AC, 60 Hz signal was applied until dielectric breakdown was observed. Testing six samples, gave the following results in Table 1.

TABLE 1

Improved Dielectric Properties of Isostatically Pressed Thick Film Dielectric Layer

| | Dielectric Thickness | Capacitance/$cm^2$ @ 1 kHz | Breakdown Voltage |
|---|---|---|---|
| UnCIPped | 24 μm | 0.120 μF/$cm^2$ | 80-90 V |
| CIPped | 16 μm | 0.156 μF/$cm^2$ | 140-160 V |

Based on the above data, using a dielectric constant of 3300 for the unCIPped material, the dielectric strength is roughly calculated as $3\times10^6$ V/m. Using a dielectric constant of 2800 for the CIPped material, the dielectric strength is roughly calculated as $10^7$ V/m.

To further smooth the surface of the dielectric layer, a second dielectric layer comprising lead zirconium titanate was applied using sol gel precursor materials, as described in Example 3 of U.S. Pat. No. 5,432,015. The thickness of this sol gel layer was about 2 μm.

Example 2

Two Layer Patterned Phosphor Structure

Reference may be had to FIG. 6 for the EL laminate of this example.

2.1. Thick Film Substrate Layers

The purpose of the thick film substrate is to provide a mechanical support, a first pixel electrode, and a thick film dielectric layer to electrically isolate the electrode from the phosphor structure. The electrical isolation is required to provide a means to control the density of current over a large area of pixels. The current control results from the injection of localized charge into the phosphor structure from the vicinity of the interface between the phosphor and a dielectric material in contact with it, rather than from the electrode itself. The dielectric layer has a high dielectric constant to minimize the voltage drop across it when a voltage is applied between the pixel electrodes, and a dielectric strength sufficient to prevent an electric breakdown of the dielectric when an appropriate voltage is applied between the pixel electrodes. The teachings of U.S. Pat. No. 5,432,015 to Wu et al., describing the thick film substrate in greater detail are incorporated herein by reference.

a) Rear Ceramic Substrate and Rear Electrode

The rear substrate was a 0.63 mm thick 96% purity alumina sheet (Coors Ceramics, Grand Junction, Colo., USA). This material typically is used for the fabrication of thick film hybrid electronic circuits. A 0.3 μm thick gold electrode with provision for making an electrical contact as shown in FIG. 5 was first deposited on the alumina substrate. The alumina was unpolished to provide sufficient surface roughness to facilitate an adequate bonding strength for the gold layer. The gold electrode was screen printed using Heraeus RP 20003/237-22% organometallic paste (Heraeus Cermalloy) to form row electrodes and then fired at 850° C. using standard manufacturers thick film methods to form the finished gold film.

b) Thick Film Dielectric Layers

The next step was to apply a thick film dielectric layer. This layer was fabricated in two individual layers, a screen printed and isostatically pressed dielectric layer, and a smoothing sol gel layer, as set out in Example 1. The thick film dielectric layer had a fired thickness of 15-20 μm, while the sol gel layer had a thickness of about 2μ.

2.2. Diffusion Barrier Layer

A 300 Å alumina layer was e-beam evaporated onto the surface of the lead zirconium titanate layer. The alumina film was deposited with the substrate at 150° C. and the deposition rate was 2 A/sec. The purpose of this layer was to prevent diffusion of atomic species in the thick film dielectric into the phosphor layer.

2.3. Injection Layer

A 100 Å hafnia layer was e-beam deposited onto the alumina diffusion barrier layer. The hafnia layer was deposited with the substrate at 150° C. and was deposited at a rate of 1 Å/sec.

2.4. Patterned Phosphor Structure a) First SrS:Ce Layer

A first SrS:Ce layer was deposited with a thickness in the range of 0.70-0.95 μm. The SrS powder used for the evaporation source was made by the process of this invention described below. The SrS was doped with 0.1% Ce by mixing the appropriate amount of $CeF_3$ into the evaporation source material. The deposition was done by reactive evaporation, with the substrate temperature at 450° C. and the deposition rate at 30 A/sec. An $H_2S$ atmosphere at a pressure of 0.01 Pa (0.1 mT) was maintained in the vacuum chamber during the deposition, sufficient to prevent a deficiency of sulphur as compared to the stoichiometric ratio in the deposited film. Following deposition, some of the parts were annealed at 600° C. in a vacuum for 45 min. to anneal the SrS:Ce layer. The annealed parts developed a web of micro-cracks in the thin film layers following the annealing, but showed somewhat higher initial luminosity in final testing, as described below.

b) Patterning of SrS:Ce Layer

Following deposition, the initial SrS:Ce layer was patterned using photo-lithographic processes. A negative polyisoprene-based photoresist material, OMR 83 available from the AZ Photoresist Products division of Hoechst Celanese Corp., Somerville N.J., was employed to protect the SrS:Ce on the blue sub-pixels during the etching process used for patterning. The viscosity of the resist was 500 centipoise and spun onto the parts at 1700 rpm for 40 sec. The viscosity was chosen to ensure that the relatively rough surface (as compared to semiconductor surfaces) was adequately covered by the resist and to optimize a subsequent lift off step set out below. The final resist thickness was in the range of 3.5 to 4.0 μm.

The resist was exposed through a patterning mask designed to allow exposure of the resist over the area corresponding to the blue sub-pixel elements.

Following exposure, the resist was developed by spraying on developer solution at while spinning the part at 1000 rpm for 30 sec. The Developer was OMR B from the AZ Photoresist Products division of Hoechst Celanese Corp., Somerville, N.J. Following application of the developer, a 50:50 mixture of developer and OMR Rinse solution were sprayed on for 10 sec, followed by an application of rinse only, for 30 sec, all while spinning the substrate at 1000 rpm. Following rinsing, the part was de-scummed in an oxygen plasma etcher for 2 min.

Following rinsing of the resist, the part was immersed in anhydrous methanol for 1 min. to allow any pores in the surface to be filled with fluid. The part was then immersed at ambient temperature in a solution of 0.5% concentrated hydrochloric acid in anhydrous methanol for 45-70 sec to dissolve the SrS:Ce from the red and green sub-pixels element areas. The etching reaction entails reaction of the hydrochloric acid with SrS:Ce to form hydrates of strontium chloride, which is soluble in methanol. The time to etch is dependent on the thickness of the SrS:Ce layer to be dissolved. The pre-immersion in pure anhydrous methanol was designed to inhibit hydrochloric acid from penetrating into the pores and causing deleterious etching or contamination of the underlying structure. Following etching, the substrates were rinsed in methanol for 2 min. and dried under a nitrogen flow. The etching solution did not dissolve the underlying hafnia injection layer material.

c) ZnS:Mn Deposition

Following etching of the initial SrS:Ce layer, a layer of ZnS:Mn was e-beam evaporated onto the part to provide the red and green phosphor sub-pixel elements. The Mn concentration was 0.8% and the layer thickness was in the range of 0.3 to 0.5 μm. The substrate temperature during deposition was 150° C. and the deposition rate was 20 A/sec.

d) Hafnia Injection Layer

This layer was provided as an interlayer to inhibit interdiffusion of dopant species between the SrS and ZnS phosphors, and at the same time preserve good electron injection conditions. The layer may not be needed, provided that good quality phosphor films are deposited. The layer was e-beam evaporated to a thickness of 300 Å with a substrate temperature of 150° C. and a deposition rate of 1 A/sec.

e) ZnS:Mn Lift-Off

In this step, the hafnia interlayer and the underlying ZnS phosphor were removed in the positions where they overlay the blue sub-pixels. This lift-off process was performed by dissolving the resist layer that remained over the blue sub-pixels during the ZnS:Mn and hafnia depositions. To initiate the lift-off process, the part was immersed in a mixture of 10% by vol. methanol in toluene at ambient temperature for 20 to 40 min. The part was removed from the solvent and wiped off, then rinsed in isopropyl alcohol for two more minutes, and dried using a nitrogen gas stream.

f) Second SrS:Ce Layer

A second SrS:Ce layer with a thickness of 0.8-0.9 μm was deposited over the entire pixel area. The deposition was done under the same conditions as for the first SrS:Ce layer. The resulting phosphor structure now consisted of a 1.6 μm thick SrS:Ce film for the blue sub-pixels (widths 150 μm) and, for the red and green sub-pixels (combined width 300 μm), a 0.4 μm thick layer of ZnS:Mn covered with a thin hafnia injection layer and a 0.8 μm thick SrS:Ce layer.

2.5. Second Injection Layer

A second 100 Å thick hafnia injection layer was deposited on top of the completed pixels (now the patterned phosphor structure) using the same deposition conditions used for the first injection layer. As for the first injection layer, the second injection layer was omitted for some of the samples.

2.6. Second Diffusion Barrier Layer

A second 300 Å thick diffusion barrier layer was deposited on top of the second injection layer using the same procedure as for the first diffusion barrier layer.

2.7. Annealing

For some samples, the entire substrate was then annealed in air for 10 min. at 550° C. The benefits and difficulties with cracking were similar as for annealing at the earlier stage.

2.8. Transparent Electrode Layer

A second resist layer was applied to the substrate using the same procedure as outlined above for the SrS:Ce layer, but using a photo-mask so as to place a resist layer in those locations that were not to be covered by the transparent electrode material. This entailed exposing the resist between those areas (shown in FIG. 5) to be covered by the transparent electrodes for each sub-pixel element 30*a*, 30*b*, and 30*c*. The transparent electrodes were designed for external connection for testing of the pixel.

An indium tin oxide layer with a thickness in the range of 3000 to 6000 Å was e-beam evaporated over the resist layer. The part was held at 250 to 350° C. during the deposition process. The deposition rate was 2 Å/sec. Alternatively, the indium tin oxide film could be deposited using sputtering. Following the deposition, the superfluous indium tin oxide was lifted off using the same process as used for lift off of the ZnS:Mn layer. Again, lift off was accomplished by dissolution of the resist layer under the indium tin oxide from the step edges. Next, the processed part was heated at 550° C. in air and held at that temperature for 10 min., cooled and then heated in nitrogen at 550° C. for a further 5 min. to anneal the indium tin oxide layer to lower its electrical resistance. The ITO lines so formed were about 130 μm wide, with 20 μm spacings.

2.9. Metal Contact Deposition

To make contact to the transparent conductors, a silver-based polymer thick film (Heraeus PC 5915) was deposited to make contact with the indium tin oxide electrodes. The conductor was printed beyond the edge of the pixel to a contact pad. The conductor paste was cured at 150° C. for about 30 minutes.

2.10. Filter Plate Attachment and Sealing

The pixel structure was overlaid with a glass cover sheet sealed to the pixel structure using an epoxy perimeter seal. The glass sheet had polymer filter film (Brewer Science) deposited on the side of the glass facing the pixel structure aligned with the red, green, and blue sub-pixel elements with the thickness of the polymer films adjusted to give appropriate colour coordinates for the respective sub-pixels. A small hole had been laser drilled through the bare alumina substrate prior to processing to provide a gas path between the rear of the substrate and the void between the front of the pixel structure and the cover plate. A ceramic pot filled with molecular sieve desiccant was sealed to the rear of the substrate aligned over the hole. The ceramic pot and the void space were evacuated through a hole in the pot and this hole was then sealed with a polymer bead (ex. curable epoxy bead). Sufficient desiccant was provided to absorb any moisture that may have accumulated in the pixel structure during processing and that may have leaked through the seals over time. This facilitated the accumulation of luminosity data over time without device degradation caused by exposure of the internal pixel structure to moisture or other atmospheric contaminants.

2.11. Test Results

Several pixel structure devices were built as described above and tested at ambient temperature with repetitive alternating positive and negative voltage pulses 85 microseconds long and 60 volts above the threshold voltage in amplitude on all three sub-pixels. The repetition rate was 180 pulses per second. Under these operating conditions, the average luminosity, as measured through the filter plates, was in the range 80-120 candelas per square meter. The average colour coordinates fell within the range $0.39<x<0.42$ and $0.38<y<0.42$. The threshold voltage for each sub-pixel was in the range of 120 to 150 volts.

Figure 3:
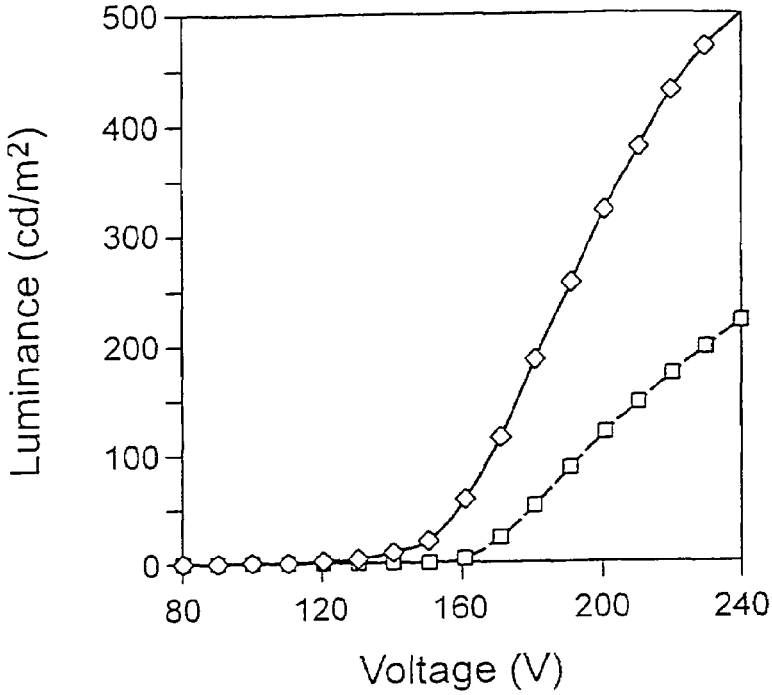
FIG. 3 is a graph comparing the unfiltered luminance plotted against voltage for the colour by white structure of FIG. 1 (shown in dotted line in the graph) and the patterned phosphor structure of FIG. 2 (shown in solid lines in the graph), at a driving frequency of 60 Hz.
Figure 4:
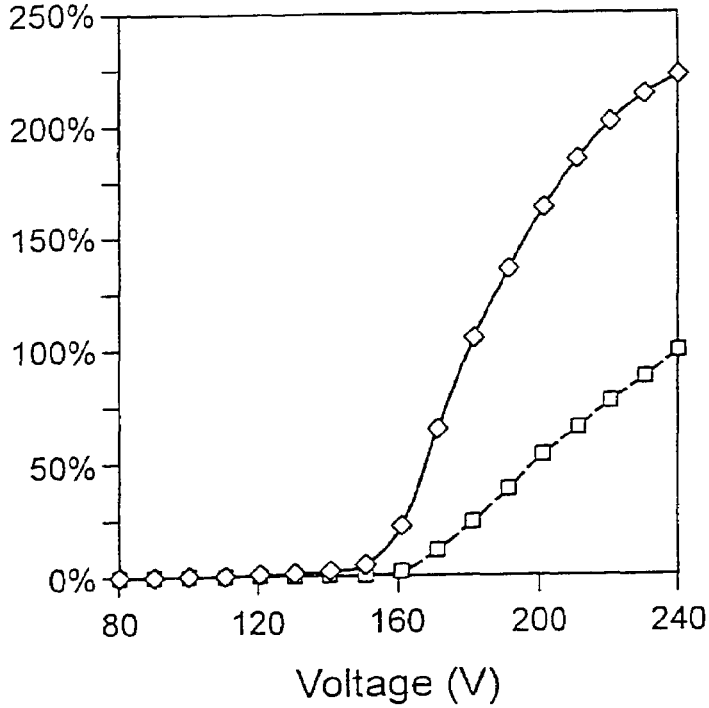
FIG. 4 is a graph comparing the filtered luminances plotted against voltage for the colour by white structure of FIG. 1 and the patterned phosphor structure of FIG. 2, at a driving frequency of 60 Hz.

The patterned phosphor structure of this example was also compared to the performance of an EL laminate prepared as in Example 2, but using conventional colour by white phosphor layers as shown schematically in FIG. 1. The SrS:Ce layer was 1 μm thick, while the ZnS:Mn layer was 0.3 μm thick. All other layers in the EL laminate were as disclosed above in this example, including a hafnia injection layer between the phosphor layers. FIGS. 3 and 4 show the luminosity vs. voltage curves for these two displays, FIG. 3 showing unfiltered luminosity and FIG. 4 showing filtered luminosity. As seen in the Figures, when threshold voltages are taken into account, the unfiltered luminosity was generally improved with the patterned phosphor structure of the present invention. The two displays had a very similar L40 (luminosity at 40 V above the threshold voltage), but at higher voltages the patterned phosphor structure display was 50% more luminous than the L60 (luminosity at 60V above the threshold voltage) of the colour by white display. However, the patterned phosphor structure display looks much different than conventional colour by white in that it is composed of alternating columns of blue and yellow-white. Since its light output is somewhat tailored to the filter above it, it is the filtered luminosity which is more important.

When differences in threshold voltages are accounted for between the two displays, FIG. 4 shows that the filtered luminosity for the patterned phosphor structure of Example 2 is generally about twice that of the colour by white display. The difference at L40 is 100%, and at L60, the difference is 110%.

Example 3

Single Layer Phosphor Structure

This variant of the patterned phosphor structure requires only a single SrS:Ce deposition and includes in the same layer, a manganese doped zinc magnesium sulfide for the red and green sub-pixel elements. For $Zn_{1-x}Mg_xS$:Mn, the value of x was in the range from 0.1 to 0.3. This phosphor has a much stronger green emission than ZnS:Mn, and can provide adequate green emission without the use of a double layer structure employing SrS and ZnS phosphors. The fabrication was as follows:

3.1. Thick Film Substrate

The substrate for this example was a 1.02 mm thick alumina sheet of approximate dimensions 12×15 inches upon which a set of 480 gold conductor strips were printed using Heraeus RP 20003/237-22% organometallic paste obtained from Heraeus Cermalloy and fired to form the addressing rows of a VGA format 17 inch diagonal display. The center-to-center spacing of the fired gold rows was 540 μm, the width of the rows was 500 μm and the length of the rows was about 27 mm (10.5 inches). A composite thick film dielectric layer of dimensions 26×35 cm (10.2×13.6 inches) was deposited on top of the addressing rows so as to leave the ends of the rows exposed for forming electrical contacts using the methods similar to those set out in Example 1. The high dielectric constant paste in this example was prepared from ink concentrate 98-42 supplied by MRA Laboratories Inc. (North Adams, Mass., U.S.A.) prepared using high dielectric constant powder comprising PMN-PT. The concentrate was mixed in a blender for 15 min. and then mixed with a solution of α-terpineol, ethyl cellulose and oleic acid in the weight ratio of 100:30:1. The proportion of concentrate to solution was 100:12 by weight. The resulting paste was vacuum filtered through a 10 μm nylon filter and degassed in vacuum for a few minutes. The paste was deposited, CIPped and fired using the methods set out in Example 1, except that the paste was sequentially printed and baked three times prior to CIPping. The thickness of the resulting high dielectric constant layer after CIPping was in the range of 15-20 μm. As in Example 1, a 2 μm thick layer of lead zirconium titanate was then applied using sol gel precursor materials.

3.2. Diffusion Barrier Layer

The barrier layer consisted of 800 Å of alumina, deposited as in Example 2.

3.3. SrS:Ce Layer

A 1.2 to 1.4 μm thick layer of SrS:Ce co-doped with phosphorus was deposited using e-beam evaporation using the method as set out in Example 2. The phosphor material was prepared as set out in the strontium sulfide synthesis section (f) below, except that the strontium carbonate powder was pre-doped with cerium and phosphorus to yield a strontium sulfide phosphor material containing about 0.1 atomic percent cerium and about 0.15 atomic percent phosphorus. The powder was fired without the addition of other powders, using the temporal temperature profile and sulfur doped process gas as described in section (f) below.

3.4. SrS:Ce Patterning

The SrS:Ce layer was removed from the green and red sub-pixel element areas using the same procedures as for Example 2, with the exception that the etching time was increased to 1-4 min. to account for the thicker SrS:Ce layer. The remaining SrS:Ce stripes were about 190 μm wide with a spacing between the stripes of 350 μm.

3.5. Zinc Magnesium Sulfide Phosphor ($Zn_{1-x}Mg_xS$:Mn)

A 3000 to 5000 Å thick zinc magnesium sulfide film doped with manganese was deposited using e-beam evaporation of ZnS doped with Mn and thermal co-evaporation of magnesium metal. The relative evaporation rates for the ZnS and Mg were adjusted so as to give a film with a Mg to Zn ratio of about 30:70. The deposition conditions and amount of dopant were similar to those of Example 2 for deposition of ZnS:Mn. An alternative to the manganese doped $Zn_{1-x}Mg_xS$:Mn phosphor layer in this example is a double phosphor layer comprising ZnS:Tb and ZnS:Mn, preferably with a diffusion barrier interlayer between them.

3.6. Threshold Voltage Adjustment Layer

A 1000 to 3000 Å alumina third dielectric layer was evaporated onto the pixel structure with the thickness chosen to equalize the threshold voltages between the red, green and blue sub-pixels. The deposition conditions were similar to those used for alumina deposition in Example 2. In this example, this threshold voltage layer was only needed over the red and green sub-pixel elements, so was subsequently removed from the blue sub-pixel elements in the next lift off step.

3.7. Zinc-Magnesium Sulfide Lift-Off

A lift off process similar to that used in Example 2 for ZnS:Mn was used to dissolve the resist covering the SrS:Ce on the blue sub-pixel elements. The dissolving time for lift-off was about 45 min. The substrate was wiped off, rinsed in clean methanol for 30 sec. and spin-dried for a further 30 sec. following etching. The result was removal of the (ZnMgS):Mn and overlying alumina layer from the blue sub-pixel elements.

3.8. Diffusion Barrier Layer Deposition

An 800 Å thick layer of alumina was deposited, as in Example 2.

3.9. Phosphor Annealing

Optionally, the phosphor structure can was annealed at this stage in a belt furnace in air for 10 min. at a peak temperature of 550° C.

3.10. Transparent Electrode Fabrication

This step to deposit and pattern column electrodes onto the display was carried out using the methods as set out in Example 2, except that the surface of the processed part was de-scummed using an oxygen plasma following the lift-off step and the part was annealed at 450° C. for 5 min. in air for 5 min. rather than at 550° C. for 10 min. following the de-scumming process. The center-to-center spacing of the columns was 180 μm and the width of the columns was 140 μm. The columns were aligned over the patterned sub-pixels. The column length was 26 cm (10.2 inches) so that the columns extended over all of the rows.

3.11. Metal Contact Deposition

Sputtered silver metal contacts were fabricated to make contact to the display assembly. For testing purposes, 20 adjacent rows were connected in parallel and 60 adjacent columns were connected in parallel so as to allow illumination of a small square on the display assembly suitable for luminosity and colour coordinate measurements.

3.12. Filter Plate Attachment and Sealing

These steps were as performed for Example 2.

3.13. Test Results

Several 17 inch diagonal displays were fabricated and tested as described above. The threshold voltage for the blue pixels was in the range of 130-160 volts. The threshold voltage for the red and green pixels was in the range 130-140 volts. When red, green and blue filters were disposed in front of the corresponding sub-pixels, it was found that a threshold voltage of 140 volts could be used to achieve a minium luminosity below 1 cd/$m^2$ for all of the pixels. The luminosity range for the combined sub-pixels with the filters in place was 35-60 cd/$m^2$ for 40 volts above the threshold voltage and a refresh rate of 120 Hz. The driving pulses were 260 microseconds in duration. The corresponding colour coordinates for the combined sub-pixels were in the range of 0.43-0.46 for x and 0.39-0.57 for y. It was noted that the colour coordinates corresponded to a slightly yellow tint due to a low relative luminosity from the blue sub-pixels. This can be corrected by slightly reducing the thickness of the phosphor used for the red and green sub-pixels and increasing the thickness of the Threshold Adjustment Layer described above, all in accordance with the present invention.

Example 4

Varying Thickness of Phosphor Deposits to Adjust Threshold Voltage

In this Example, as in Example 3, there was only one SrS:Ce deposit for the blue sub-pixels, and one $Zn_{1-x}Mg_xS$:Mn deposit for the red and green sub-pixels. The phosphors were made and doped as set out in Example 3, with the approximate value of x in the $Zn_{1-x}Mg_xS$:Mn phosphor being between about 0.2 and 0.3. However, in this example, no threshold voltage adjustment layer was used. Rather, the $Zn_{1-x}Mg_xS$:Mn layer was deposited thick enough to balance the threshold voltages. If nothing else was changed, this would lead to a colour imbalance, with the red and green sub-pixels being more than 3 and 6 times as luminous respectively, as the blue sub-pixels. As a result, the filtered white would be too yellow. In this example, this colour imbalance was solved by making the blue sub-pixels wider than the red or green sub-pixels.

The substrates used for this example were 5.1×5.1 cm (2×2 inch)substrates, as set forth in Example 2.

4.1. Thick Film Substrate

The thick film substrate layers of Example 2 were used to provide the rear substrate, rear row electrode and thick film dielectric layers.

4.2. Diffusion Barrier Layer

The barrier layer consisted of 500 Å of alumina, deposited as in Example 2. No injection layer was used in this example.

4.3. SrS:Ce Layer

A 1.2-1.6 μm thick layer of SrS:Ce was deposited by e-beam evaporation, the phosphor being prepared and deposited as described in Example 3.

4.4. SrS:Ce Patterning

The SrS:Ce layer was removed from the red and green sub-pixels using the procedure described in Example 3. The remaining SrS:Ce stripes were about 320 μm wide, with a spacing between the stripes of 220 μm.

4.5. Barrier Layer

A 500 Å layer of undoped ZnS was deposited at this stage by e-beam evaporation. The purpose of this layer was to provide a barrier layer. When this step was omitted, the lower thick film dielectric layer tended to darken during the later annealing step. This layer of undoped ZnS prevented this darkening. It also provided a cleaner interface for the ZnS:Mn, removing the phosphor from any residue that resulted from the SrS:Ce patterning step.

4.6. Zinc Sulfide/Zinc Magnesium Sulfide Phosphor Layers

A 800-1000 Å layer of ZnS:Mn was deposited next, followed by a 4000-6000 Å layer of $Zn_{1-x}Mg_xS$:Mn, and then by a 800-1000 Å layer of ZnS:Mn. The ZnS:Mn was deposited as described in Example 2, whereas the $Zn_{1-x}Mg_xS$:Mn was deposited as in Example 3.

4.7. Barrier Layer

Another 500 Å barrier layer of ZnS was deposited at this point by e-beam evaporation.

4.8. Zinc Magnesium Sulfide Lift-Off

The resist covering the SrS:Ce on the blue sub-pixels was dissolved in the same way as in Example 3. The rinsing procedure was different in that the substrates were soaked in clean, anhydrous methanol for 2 min. and then dried under a nitrogen flow.

4.9. Barrier Layer

An upper barrier layer of 500 Å of alumina was deposited.

4.10. Phosphor Annealing

The phosphor was annealed at this stage in a belt furnace in air for 10 min. at a peak temperature of 550° C.

4.11. Transparent Electrode Fabrication

The indium tin oxide layer was deposited by sputtering using a current of 2 Amps, a temperature of 25° C., a pressure of 1.06 Pa (8 mTorr), an oxygen flow of 0.2 sccm, and an argon flow of about 70 sccm (balanced to give above pressure), to a thickness of 5000 A.

4.12. Metal Contact Deposition

The metal contacts were printed using polymer thick film silver paste as in Example 2.

4.13. Filter Plate Attachment and Sealing

These steps were performed as described in Example 2. The filter had the following line widths; red-60 μm, green-110 μm, blue-310 μm. The gaps between the lines (where the colours overlapped) were 20 μm wide. The total pixel width was 540 μm.

4.14. Test Results

Several 5.1×5.1 cm (2×2 inch) panels were made by the above procedure and were tested as in Example 2. The results of the better panels were as follows:

| | |
|---|---|
| Threshold voltage (blue sub-pixels) | 130-170 V |
| Threshold voltage (red, green sub-pixels) | 160-200 V |
| Overall threshold voltage used (<5 cd/m$^2$) | 160-180 V |
| Luminosity (white, filtered) | 165-260 cd/m$^2$ |
| White colour coordinates (x) | 0.38-0.44 |
| White colour coordinates (y) | 0.40-0.45 |
| CIE colour coordinates | Red x = 0.62, y = 0.38 |
| | Green x = 0.42, y = 0.58 |
| | Blue x = 0.13, y = 0.14 |

In this example, the threshold voltages of the red and green sub-pixels were much higher than those of the blue sub-pixels. This can be prevented by reducing the thickness of the $Zn_{1-x}Mg_xS$:Mn phosphor and increasing the thickness of the SrS:Ce phosphor. As a result of this discrepancy, the blue sub-pixels were too luminous for the red and green sub-pixels at lower voltages. For this reason, a higher threshold voltage was chosen, such that the filtered luminosity at threshold was as high as 5 cd/m$^2$. If the phosphor thicknesses were changed to bring the two threshold voltages in line, the colour balance would be better, the luminosity at threshold voltage would be <1 cd/m$^2$, and the total luminosity would be higher.

Example 5

Single Layer Phosphor Structure with SrS:Ce for Green and Blue, Varying Sub-pixel Widths This example, like the previous two examples, includes only one SrS:Ce deposition and one ZnS:Mn deposition. As in Example 4, the sub-pixel widths was adjusted in order to balance the colour. In addition, however, a Threshold Voltage Adjustment Layer was used to further increase the threshold voltage of the ZnS:Mn layer without increasing its luminosity. Another difference is in the phosphors that have been used for the different colours. SrS:Ce alone was used for both the blue and green sub-pixels, and ZnS:Mn was used for the red sub-pixels, rather than $Zn_{1-x}Mg_xS$:Mn, since no green was required from this phosphor.

The substrates used were 5.1×5.1 cm (2×2 inch) substrates, as in Example 2.

5.1. Thick Film Substrate

The thick film substrate layers of Example 2 were used to provide the rear substrate, rear row electrode and thick film dielectric layers.

5.2. Diffusion Barrier Layer

A barrier layer of 500 Å alumina was deposited.

5.3. Injection Layer

An injection layer of 100 Å hafnia was deposited.

5.4. SrS:Ce Phosphor Layer

A 1.2-1.4 μm layer of SrS:Ce was deposited by e-beam evaporation as described in Example 4.

5.5. SrS:Ce Patterning

The SrS:Ce layer was removed from the red sub-pixels using the procedure described in Example 3, with removal times of 1-2 min. The width of the resulting SrS:Ce lines was 470 μm and the gaps between the lines were 70 μm.

5.6. Barrier Layer

A 300 Å layer of alumina was deposited at this stage by e-beam evaporation. The purpose of this step was to provide a cleaner interface for the ZnS:Mn, removing the phosphor from any residue that resulted from the SrS:Ce patterning step.

5.7. Zinc Sulfide Phosphor Layer

A 4500 Å layer of ZnS:Mn was deposited as described in Example 2.

5.8. Threshold Voltage Adjustment Layer

A layer of 1800 Å thick alumina was deposited in the same manner as for the barrier layer.

5.9. Zinc Sulfide Lift-Off

The resist covering the SrS:Ce on the blue sub-pixels was dissolved in the same manner as in Example 4.

5.10. Injection Layer

An upper injection layer of 100 Å of hafnia was deposited.

5.11. Barrier Layer

An upper barrier layer of 500 Å of alumina was deposited.

5.12. Phosphor Annealing

The phosphor was annealed at this stage in a belt furnace in air for 10 min. at a peak temperature of 550° C.

5.13. Transparent Electrode Fabrication

The indium tin oxide electrodes were deposited by sputtering, using a current of 2 Amps, a temperature of 25° C., a pressure of 1.06 Pa (8 mTorr), an oxygen flow of 0.2 sccm, and an argon flow of about 70 sccm (balanced to give above pressure), to a thickness of 5000 Å.

5.14. Metal Contact Deposition

The metal contacts were made from chromium, followed by Al, sputtered as follows:

Cr: power 15 kW, temp. 150° C., pressure 0.26 Pa (2 mTorr), thickness 600 Å;

Al: power 10 kW, temp. 25° C., pressure 0.26 Pa (2 mTorr), thickness 6800 Å.

5.15. Filter Plate Attachment and Sealing

These steps were performed as described in Example 2. The filter had the following line widths: red-60 μm, green-270 μm, blue-150 μm. The gaps between the lines (where the colours overlapped) were 20 μm. The total pixel width was 540 μm. The green sub-pixel was much wider than in Example 4. This was because the SrS:Ce was not nearly as bright, even with the green filter, as $Zn_{1-x}Mg_xS$:Mn, and so the green sub-pixels were made wider to compensate.

5.16. Test Results

Several 5.1×5.1 cm (2×2 inch) panels were made by this procedure, and tested as in Example 2. The results were as follows:

| | |
|---|---|
| Threshold voltage (blue, green sub-pixels) | 140-170 V |
| Threshold voltage (red sub-pixels) | 130-150 V |
| Overall threshold voltage used (<1 cd/m$^2$) | 130-150 V |
| Luminosity (white, filtered) | 40-64 cd/m$^2$ |
| White colour coordinates (x) | 0.35-0.46 |
| White colour coordinates (y) | 0.39-0.42 |

It will be noted that these panels also had good colour saturations, like Example 4. For blue, x~0.13, y~0.15, for green, x~0.23, y~0.58, and for red, x~0.65, y~0.35.

f) Strontium Sulfide Synthesis

The performance of the phosphor structure described above was found to be highly dependent upon the quality of the SrS powder used as a source material for the SrS phosphor. The following preparation was used to maximize luminance efficiency and blue purity.

The desired properties of phosphor films comprising 0.12% Ce doped SrS are a luminosity of 80 candelas per square meter or higher, up to 200 cd/m$^2$, and colour coordinates of $0.19<x<0.20$ and $0.34<y<0.40$ corresponding to blue when excited with 80 microsecond pulses having an amplitude of 40 volts above the threshold voltage and a repetition rate of 120 pulses/sec. If the preparation procedure for the SrS is not carefully controlled, the luminosity decreases and the colour coordinates shift to x up to 0.3 and y up to 0.5, significantly toward green.

In accordance with this invention, the SrS synthesis reaction should be controlled in order to occur homogeneously. Generally, this entails providing a strontium carbonate precursor powder in a dispersed form so that it is substantially uniformly exposed to the process conditions. This can be achieved by using small batches, using volatile, non-contaminating, clean evaporating compounds or solvents which decompose into gaseous products prior to the onset of the reaction, or by using a fluidized bed or tumbler reactor. It is also important to achieve a slow and uniform conversion of a strontium carbonate precursor powder to strontium sulfide, in the presence of sulfur vapours, at an elevated temperature in the range of 800-1200° C. Without such control, variation is observed in the photoluminescent emission spectrum and luminosity of the SrS powder, using broadband ultraviolet illumination, and in the electroluminescent emission spectrum and luminosity efficiency of the deposited SrS phosphor layers made from the powder. The basic synthesis reaction can be written as:

$$4\ SrCO_3+3\ S_2 \square 4\ SrS+2\ SO_2+4\ CO_2$$

The reaction occurs in two steps, with the first step involving the decomposition of the strontium carbonate to oxygen-containing strontium compounds and carbon dioxide, and the second step involving a reaction with sulfur to produce strontium sulfide and sulfur dioxide (or perhaps other sulfur oxides). The interrelationship between these two steps is found to have a significant bearing on the quality of powder that is produced.

The reactor for the synthesis consists of a quartz or ceramic tube positioned in the hot zone of a tube furnace into which a strontium carbonate powder is placed. The tube material of the reactor should not react chemically with the reactants or reaction products. In this example, a 3.8 cm (1.5 inch) diameter alumina tube having a length in the hot zone of about 30 cm (12 inches) was used. The tube was loaded with about 75 grams of a strontium carbonate powder in the hot zone. The strontium carbonate had a purity level of greater than 99.9% on a metal basis. Powders of such purity may be commercially obtained or generated by precipitating strontium nitrate or strontium hydroxide with ammonium carbonate. The tube was heated gradually, at a rate not exceeding 5 to 10° C./min, to a maximum temperature in the range of 800 to 1200° C. The preferred maximum temperature is about 1100° C.

At about the time the maximum temperature is reached, a continuous flow of sulfur vapour is introduced into an argon gas stream (i.e., in an inert atmosphere) at atmospheric pressure entering the reaction tube. The sulfur vapour may be generated by either placing a container containing elemental sulfur at the entrance end of heated reaction tube, or by heating a separate stainless steel container filled with sulfur to between 360 and 440° C. which is connected to the entrance end of the reaction tube. An appropriate amount of sulfur vapour is introduced by adjusting the pot temperature and the argon flow rate. A Ferran Scientific mass spectrometer is connected to the exit end of the reaction tube, and the relative concentrations of carbon dioxide and sulfur dioxide are measured. The reaction is terminated when the mass spectrometer reading of a predetermined concentration of sulfur dioxide is reached. This is done by switching off the sulfur flow into the tube and by cooling down the furnace. The sulfur vapour flow is stopped by turning off the sulfur pot heater. The argon flow continues until the furnace is cool enough for unloading the product, typically below 200° C. The firing time at the maximum temperature is typically in the range of 2 to 8 hours, depending on the maximum temperature, the sulfur vapour delivery rate, the strontium carbonate powder packing density and the end point, at which time the reaction is terminated.

The end point is considered reached when the mass spectrometer reading of $SO_2$ falls into the range between 0.001-0.01 Pa ($1\times10^{-5}$ to $1\times10^{-4}$ Torr) in a base pressure of 0.2-0.3 Pa ($2\times10^{-3}$ to $3\times10^{-3}$ Torr). This results in a small residual quantity of oxygen-containing strontium compounds, or possibly a fraction of that in the form of strontium carbonate, (i.e., oxygen-containing strontium compounds) remaining in the strontium sulfide product, the presence of which correlates with improved phosphor performance. The most luminous phosphor films have been made using strontium sulfide powders containing about 5 atomic percent of oxygen-containing strontium compounds, but good phosphors may be made over a range of oxide concentrations. The preferred range of concentrations of oxygen-containing strontium compounds is 1 to 10 atomic percent. The correlation between oxide content and phosphor performance is fairly weak, due to the influence of other variables during phosphor preparation. However, it is generally observed that strontium sulfide with too little oxide correlates with a shift from blue to green in photoluminescence from the powder and a deleterious shift from blue to green in electroluminescence of phosphor films prepared therefrom.

The strontium carbonate starting powder can be doped with cerium carbonate, cerium fluoride, or another form of cerium additive, or the dopant can be added later as cerium fluoride or cerium sulfide to the resulting strontium sulfide powder, or the dopant may be added prior to phosphor film deposition. No significant dependence of phosphor performance on the method of cerium introduction has been found to exist. The amount of the dopant is preferably in the range of 0.01 to 0.35 mole %, more preferably 0.05 to 0.25%.

The initial form of the strontium carbonate powder does have a significant impact on phosphor performance. It is desirable that the powder has a high porosity, and does not fuse during reaction with sulfur. A densely packed strontium carbonate powder specimen or one that fuses during reaction tends to result in green shift in the photoluminescence and electroluminescence of the films deposited with the strontium sulfide powder therefrom, and is thus undesired. A loosely packed powder usually gives the best performance for the phosphor.

The impact of the porosity or the dispersed form of the bulk strontium carbonate powder on the quality of the strontium sulfide phosphor is also reflected in the reaction mechanism as evidenced by the relative conversion rate to strontium sulfide at the second stage of the reaction. For a densely packed powder with low porosity, the conversion is usually fast with the onset of sulfur dioxide evolution occurring at about 10 minutes after the onset of carbon dioxide evolution. For a loosely packed powder with high porosity, the onset of sulfur dioxide evolution occurs at a much later time, as long as 100 minutes after the onset of carbon dioxide evolution.

The porosity of the powder helps ensure that the process environment is essentially uniform throughout the material being processed, allowing unrestricted diffusion of the sulfur vapour and gaseous reaction products. This is believed to help ensure that the product particles are homogeneous on an atomic scale. Types of atomic scale inhomogeneity include lattice substitutions, interstitial atoms, vacancies and clusters thereof. Lattice substitutions do not necessarily imply that an impurity atom is present, and may include positioning of a strontium atom where a sulfur atom should be, and vice versa. Even though the powder is vaporized during phosphor deposition, clusters of atoms rather than individual atoms may vaporize, preserving atomic scale defects initially present in the source powder used for the deposited films.

Several methods to achieve high strontium carbonate powder dispersion or porosity have been developed. One is to mix the strontium carbonate powder with a volatile, clean evaporating non-contaminating powdered compound that decomposes into gaseous products prior to the onset of reactions involving strontium carbonate. Examples of such compounds are high purity powder such as ammonium carbonate, ammonium sulphate and elemental sulfur. The additive can be added giving a weight ratio of additive to strontium carbonate in the range of 1:9 to 1:1, but preferably is in the range of 1:4 to 1:2.5. This method works well with the free flowing strontium carbonate powder made from strontium nitrate and ammonium carbonate.

A second method to effect powder porosity or dispersion is to soak the powder in a solvent that penetrates the powder, modifying the surface properties of the strontium carbonate particles to prevent it from fusing during the reaction with sulfur vapour at high temperatures. The strontium carbonate is mixed with a non-contaminating solvent to form a slurry, which is then partially dried in air at ambient temperature or with mild heating depending on the nature of the solvent to form a free flowing powder. The powder should undergo a weight gain of between 5 and 30% as compared to completely dry powder. The partially dried powder can be loaded in the reactor tube according to the usual procedure. The solvent can include, but is not limited to, acetone, methanol, ethanol and water. This method works well with the granular and sticky strontium carbonate powder such as that made from strontium hydroxide and ammonium carbonate.

The use of argon as an inert carrier gas is preferred. When forming gas (5% hydrogen in argon) is used in place of argon, green shift in the photoluminescence and electroluminescence of the films deposited from the powder is again observed.

Sample size is another significant factor that affects the quality of the strontium sulfide. Large samples of 150 grams of strontium carbonate, also lead to a green shift of emission spectrum of the film. This is believed to be a direct result of the inhomogeneous reaction of the powder with the reactant since repeated regrinding and firing tends to improve the quality of the strontium sulfide.

All publications mentioned in this specification are indicative of the level of skill of those skilled in the art to which this invention pertains. All publications are herein incorporated by reference to the same extent as if each individual publication was specifically and individually indicated to be incorporated by reference.

The terms and expressions used in this specification are used as terms of description and not of limitation. There is no intention, in using such terms and expressions, of excluding equivalents of the features shown and described.

We claim:

1. A method of forming an EL laminate of the type including one or more phosphor layers sandwiched between a front and a rear electrode, the phosphor layer being separated from the rear electrode by a thick film dielectric layer, comprising the steps of:

a) providing a rigid rear substrate;

b) forming the rear electrode on the rear substrate;

c) depositing a first ceramic material paste above the rear electrode in one or more layers by a thick film technique to form a thick film dielectric layer having a thickness of 10 to 300 μm;

d) drying and then pressing the thick film dielectric layer, the rear electrode and the rear substrate, using a sheet of non-stick material in contact with the thick film dielectric layer during the pressing step, to form a densified thick film dielectric layer with reduced porosity and surface roughness prior to sintering;

e) subsequent to pressing, sintering the thick film dielectric layer, the rear electrode and the rear substrate to form a pressed, sintered thick film dielectric layer;

f) depositing a second ceramic material by a sol gel technique on the pressed, sintered thick film dielectric layer and then heating to form a sol gel dielectric layer to further smooth the surface of the thick film dielectric layer;

g) forming one or more phosphor layers above the sol gel dielectric layer; and h) forming the front electrode above the one or more phosphor layers, wherein the EL laminate so formed has an improved uniform luminosity over an EL laminate of the same composition but formed without the pressing step.

2. The method as set forth in claim 1, wherein the pressing is isostatic pressing.

3. The method as set forth in claim 1, wherein the pressed, sintered thick film dielectric layer has a thickness, after sintering, sufficient to prevent dielectric breakdown during operation as determined by the equation $d_2=V/S$, wherein $d_2$ is the thickness of the thick film dielectric layer, V is the maximum applied voltage and S is the strength of the first ceramic material.

4. The method as set forth in claim 3, wherein $d_2$ is 10 μm or greater.

5. The method as set forth in claim 1, wherein the pressing is cold isostatic pressing at up to 350,000 kPa.

6. The method of claim 5, wherein the non-stick material is an aluminized polyester, with an aluminized surface in contact with the thick film dielectric layer.

7. The method as set forth in claim 5, wherein the first ceramic material is deposited by screen printing, in one or more layers.

8. The method as set forth in claim 7, wherein the second ceramic material is a ferroelectric ceramic material.

9. The method as set forth in claim 8, wherein the first ceramic material is pressed to reduce the thickness, after sintering, by 20 to 50%.

10. The method as set forth in claim 8, wherein the first ceramic material is pressed to a thickness, after sintering, of between 10 and 20 μm.

11. The method as set forth in claim 10, wherein the thick film dielectric layer has a deposited thickness of 20 to 50 μm.

12. The method as set forth in claim 11, wherein the first ceramic material is a ferroelectric ceramic material having a dielectric constant greater than 500.

13. The method as set forth in claim 8, wherein the first ceramic material is a ferroelectric ceramic material having a dielectric constant greater than 500.

14. The method as set forth in claim 13, wherein the first ceramic material has a perovskite crystal structure.

15. The method as set forth in claim 14, wherein the first ceramic material is selected from the group consisting of one or more of $BaTiO_3$, $PbTiO_3$, PMN and PMN-PT.

16. The method as set forth in claim 14, wherein the first ceramic material is selected from the group consisting of $BaTiO_3$, $PbTiO_3$, PMN and PM N-PT.

17. The method as set forth in claim 16, wherein the first ceramic material is PMN-PT.

18. The method as set forth in claim 8, wherein the second ceramic material has a dielectric constant of at least 20 and a thickness of at least about 1 μm.

19. The method as set forth in claim 18, wherein the second ceramic material has a dielectric constant of at least 100.

20. The method as set forth in claim 19, wherein the second ceramic material has a thickness in the range of 1 to 3 μm.

21. The method as set forth in claim 20, wherein the second ceramic material is deposited by a sol gel technique selected from spin deposition or dipping, followed by heating to convert to the sol gel dielectric layer.

22. The method as set forth in claim 21, which further comprises, depositing a diffusion barrier layer above the sol gel dielectric layer, which diffusion barrier layer is composed of a metal-containing electrically insulating binary compound that is chemically compatible with any adjacent layers and which differs from its precise stoichiometric composition by less than 0.1 atomic percent.

23. The method as set forth in claim 21, which further comprises, depositing an injection layer above the sol gel dielectric layer to provide a phosphor interface, composed of a binary, dielectric material which is non-stoichiometric in its composition and having electrons in a range of energy for injection into the one or more phosphor layers.

24. The method of claim 21, wherein the EL laminate is for an EL display and wherein the rear electrode is formed as rows of conductive metal address lines and the front electrode is formed as columns of transparent address lines arranged perpendicularly to the row address lines.

25. The method as set forth in claim 24, wherein the pressed, sintered thick film dielectric layer, compared to an unpressed, sintered dielectric layer of the same composition, has improved dielectric strength which is greater than $5.0\times 10^6$ V/m and uniform luminosity over a scale of about 10 μm in an EL laminate.

26. The method as set forth in claim 21, wherein the second ceramic material is a ferroelectric ceramic material having a perovskite crystal structure.

27. The method as set forth in claim 26, wherein the second ceramic material is lead zirconium titanate or lead lanthanum zirconate titanate.

28. The method as set forth in claim 27, wherein the substrate and the rear electrode are formed from materials which can withstand temperatures of about 850° C.

29. The method as set forth in claim 28, wherein the substrate is an alumina sheet.

30. The method as set forth in claim 29, which further comprises, depositing a diffusion barrier layer above the sol gel dielectric layer, which diffusion barrier layer is composed of a metal-containing electrically insulating binary compound that is chemically compatible with any adjacent layers and which differs from its precise stoichiometric composition by less than 0.1 atomic percent.

31. The method as set forth in claim 30, wherein the diffusion barrier layer is formed from alumina, silica, or zinc sulfide.

32. The method as set forth in claim 31, wherein the diffusion barrier is formed from alumina.

33. The method as set forth in claim 32, wherein the diffusion barrier has a thickness of 100 to 1000 A.

34. The method as set forth in claim 30, which further comprises, depositing an injection layer above the diffusion barrier layer, to provide a phosphor interface, composed of a binary, dielectric material which is non-stoichiometric in its composition and having electrons in a range of energy for injection into the one or more phosphor layers.

35. The method as set forth in claim 34, wherein the injection layer is hafnia when the phosphor is a zinc sulfide phosphor, and wherein the diffusion barrier layer is zinc sulfide when the phosphor is a strontium sulfide phosphor.

36. The method as set forth in claim 34, wherein the injection layer is formed from a material which has greater than 0.5% atomic deviation from its stoichiometric composition.

37. The method as set forth in claim 36, wherein the injection layer is formed from hafnia or yttria.

38. The method as set forth in claim 37, wherein the injection layer has a thickness of 100 to 1000 A.

* * * * *

UNITED STATES PATENT AND TRADEMARK OFFICE

CERTIFICATE OF CORRECTION

PATENT NO. : 7,427,422 B2
APPLICATION NO. : 11/122301
DATED : September 23, 2008
INVENTOR(S) : Xingwei Wu and George A. Kupsky It is certified that error appears in the above-identified patent and that said Letters Patent is hereby corrected as shown below:

Title Page
Item (73), ASSIGNEE, should read --IFire IP Corporation--.

Signed and Sealed this

Twenty-third Day of December, 2008

JON W. DUDAS
*Director of the United States Patent and Trademark Office*